US010795310B2

(12) United States Patent
Munetsugu et al.

(10) Patent No.: US 10,795,310 B2
(45) Date of Patent: Oct. 6, 2020

(54) CARTRIDGE HAVING A REGULATING MEMBER THAT REGULATES MOVEMENT OF A DEVELOPING UNIT

(71) Applicant: CANON KABUSHIKI KAISHA, Tokyo (JP)

(72) Inventors: Hiroyuki Munetsugu, Yokohama (JP); Goshi Ozaki, Yokohama (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 15/988,837

(22) Filed: May 24, 2018

(65) Prior Publication Data

US 2018/0341215 A1 Nov. 29, 2018

(30) Foreign Application Priority Data

May 26, 2017 (JP) ..... 2017-104162

(51) Int. Cl.
*G03G 21/18* (2006.01)

(52) U.S. Cl.
CPC ..... *G03G 21/1825* (2013.01); *G03G 21/1864* (2013.01)

(58) Field of Classification Search
CPC ..... G03G 21/1825
USPC ..... 399/119
See application file for complete search history.

(56) References Cited

U.S. PATENT DOCUMENTS

2002/0071693 A1* 6/2002 Shimaoka ..... G03G 21/1825 399/113
2008/0138109 A1* 6/2008 Anan ..... G03G 21/1821 399/113

FOREIGN PATENT DOCUMENTS

| | | | |
|---|---|---|---|
| JP | 2005-43538 | A | 2/2005 |
| JP | 2005-99517 | A | 4/2005 |
| JP | 2008-170944 | A | 7/2008 |
| JP | 2009-288302 | A | 12/2009 |
| JP | 2016-110122 | A | 6/2016 |
| JP | 2016-110134 | A | 6/2016 |
| JP | 2016-110141 | A | 6/2016 |

OTHER PUBLICATIONS

Asanuma et al. Translation of JP 2016110134. Published Jun. 2016. Translated Mar. 2019. (Year: 2016).*

* cited by examiner

*Primary Examiner* — Walter L Lindsay, Jr.
*Assistant Examiner* — Philipmarcus T Fadul
(74) *Attorney, Agent, or Firm* — Canon U.S.A., Inc. I.P. Division

(57) ABSTRACT

Provided is a cartridge that includes a photosensitive member unit, a development unit that moves with respect to the photosensitive member unit so as to be movable between a first position and a second position, a regulating member that is movable between a regulating position at which the regulating member contacts the photosensitive member unit and the development unit to regulate movement of the development unit from the first position to the second position and a nonregulating position at which movement of the development unit is not regulated, and an urging member that urges the regulating member to move the regulating member from the nonregulating position to the regulating position.

32 Claims, 21 Drawing Sheets

CARTRIDGE HAVING A REGULATING MEMBER THAT REGULATES MOVEMENT OF A DEVELOPING UNIT

BACKGROUND OF THE INVENTION

Field of the Invention

The present disclosure relates to a cartridge that is used by being attached to an electrophotographic image forming apparatus.

Description of the Related Art

An electrophotographic image forming apparatus (hereinafter, referred to as an image forming apparatus) forms an image on a recording medium by using an electrophotographic image forming process, and examples thereof include a copier, a laser beam printer, a facsimile, and the like. The image forming apparatus generally has a configuration in which consumable parts such as a photosensitive member, a developer bearing member, and developer are contained in a cartridge that is detachably attachable to a main body of the image forming apparatus and, by replacing the cartridge, maintenance of the image forming apparatus is able to be performed.

Japanese Patent Laid-Open No. 2005-99517 discloses a cartridge which includes a photosensitive member unit provided with a photosensitive member and a development unit provided with a development roller, and in which the development unit is movable with respect to the photosensitive member unit. Japanese Patent Laid-Open No. 2005-99517 discloses a configuration in which a hook (regulating member) that regulates movement of a development unit with respect to a photosensitive member unit is provided in a cartridge.

In the configuration in which the development unit is movable with respect to the photosensitive member unit, a user may move the development unit with respect to the photosensitive member unit while the cartridge is not attached to an image forming apparatus. In a case where the development unit is vigorously moved with respect to the photosensitive member unit, for example, there is possibility that an impact force is applied to the development unit and the photosensitive member unit and the development unit and the photosensitive member unit are broken. In a case where the cartridge is attached to the image forming apparatus, when the cartridge is attached vigorously, for example, there is possibility that a position of the development unit with respect to the photosensitive member unit is not stable and the cartridge is difficult to be attached with the photosensitive member unit and the development unit in an appropriate state.

According to Japanese Patent Laid-Open No. 2005-99517, the hook regulates movement of the development unit with respect to the photosensitive member unit, so that the breakage of the development unit or the photosensitive member unit as described above is able to be suppressed and the cartridge is able to be attached with the photosensitive member unit and the development unit in an appropriate state.

In the configuration of Japanese Patent Laid-Open No. 2005-99517, however, in a case where the cartridge is attached to a main body of the image forming apparatus once or a case where the hook is erroneously moved before the cartridge is attached to the image forming apparatus, for example, the hook moves to a nonregulating position where regulation is released. Thus, when the cartridge attached to the image forming apparatus is detached from the image forming apparatus, a situation where the development unit is moved with respect to the photosensitive member unit or a situation where the cartridge is attached to the image forming apparatus again with the regulation released is caused. A situation where the cartridge attached to the image forming apparatus needs to be detached from the image forming apparatus is caused, for example, when maintenance of the cartridge itself, for example, such as jam clearance or cleaning is performed or an operation of replacing a developer unit which is attached to the development unit and supplies developer is performed.

In terms of usability, it is not desirable to urge the user to move the hook from the nonregulating position to a regulating position after detaching the cartridge from the image forming apparatus.

SUMMARY OF THE INVENTION

In view of the concerns described above, the present disclosure suppresses, after a cartridge that is attached once is detached from an image forming apparatus, breakage of a development unit and a photosensitive member unit or attachment of the cartridge with the development unit and the photosensitive member unit in an inappropriate state, while suppressing lowering of usability.

The disclosure provides a cartridge including: a photosensitive member unit that is provided with a photosensitive member; a development unit that is provided with a developer bearing member supplying developer to the photosensitive member, and that moves with respect to the photosensitive member unit so as to be movable between a first position at which the developer bearing member supplies the developer to the photosensitive member and a second position at which the developer bearing member is farther from the photosensitive member than the first position; a regulating member that is movable between a regulating position at which the regulating member contacts the photosensitive member unit and the development unit to regulate movement of the development unit from the first position to the second position and a nonregulating position at which movement of the development unit is not regulated; and an urging member that urges the regulating member to move the regulating member from the nonregulating position to the regulating position.

Further features of the present disclosure will become apparent from the following description of exemplary embodiments with reference to the attached drawings.

DESCRIPTION OF THE EMBODIMENTS

First Embodiment

A cartridge as a first embodiment and an image forming apparatus to which the cartridge is attachable will be described in accordance with drawings. A process cartridge P is roughly divided into a photosensitive member unit C that includes a photosensitive drum (image bearing member) 10, and a development unit B1 that includes a development roller (developer bearing member) 13 bearing toner (developer) to be bonded to an electrostatic latent image formed on the photosensitive drum 10. The photosensitive member unit C and the development unit B1 integrally form one process cartridge P that is detachably attachable to an image forming apparatus A1.

In the following description, longitudinal directions of the process cartridge P, the photosensitive member unit C, and the development unit B1 are directions parallel to a rotational axis L1 (refer to FIG. 8A) of the photosensitive drum 10 and a rotational axis L9 (refer to FIG. 6A) of the development roller 13. In a state where the photosensitive member unit C and the development unit B1 are coupled to be integrated, the rotational axis L1 of the photosensitive drum 10 is parallel to the rotational axis L9 of the development roller 13 regardless of a position of the development unit B1 with respect to the photosensitive member unit C. Additionally, in a state where the process cartridge P is attached to the image forming apparatus A1, the rotational axis L1 of the photosensitive drum 10 and the rotational axis L9 of the development roller 13 are orthogonal to (intersect) a conveyance direction of a recording medium. Transverse directions of the process cartridge P, the photosensitive member unit C, and the development unit B1 are directions orthogonal to the rotational axis L1 of the photosensitive drum 10 and the rotational axis L9 of the development roller 13. In the present embodiment, a direction in which the process cartridge P is attached to or detached from an apparatus main body A2 of the image forming apparatus A1 is the transverse direction of the process cartridge P.

<Overall Configuration of Image Forming Apparatus and Image Forming Process>

Figure 2:
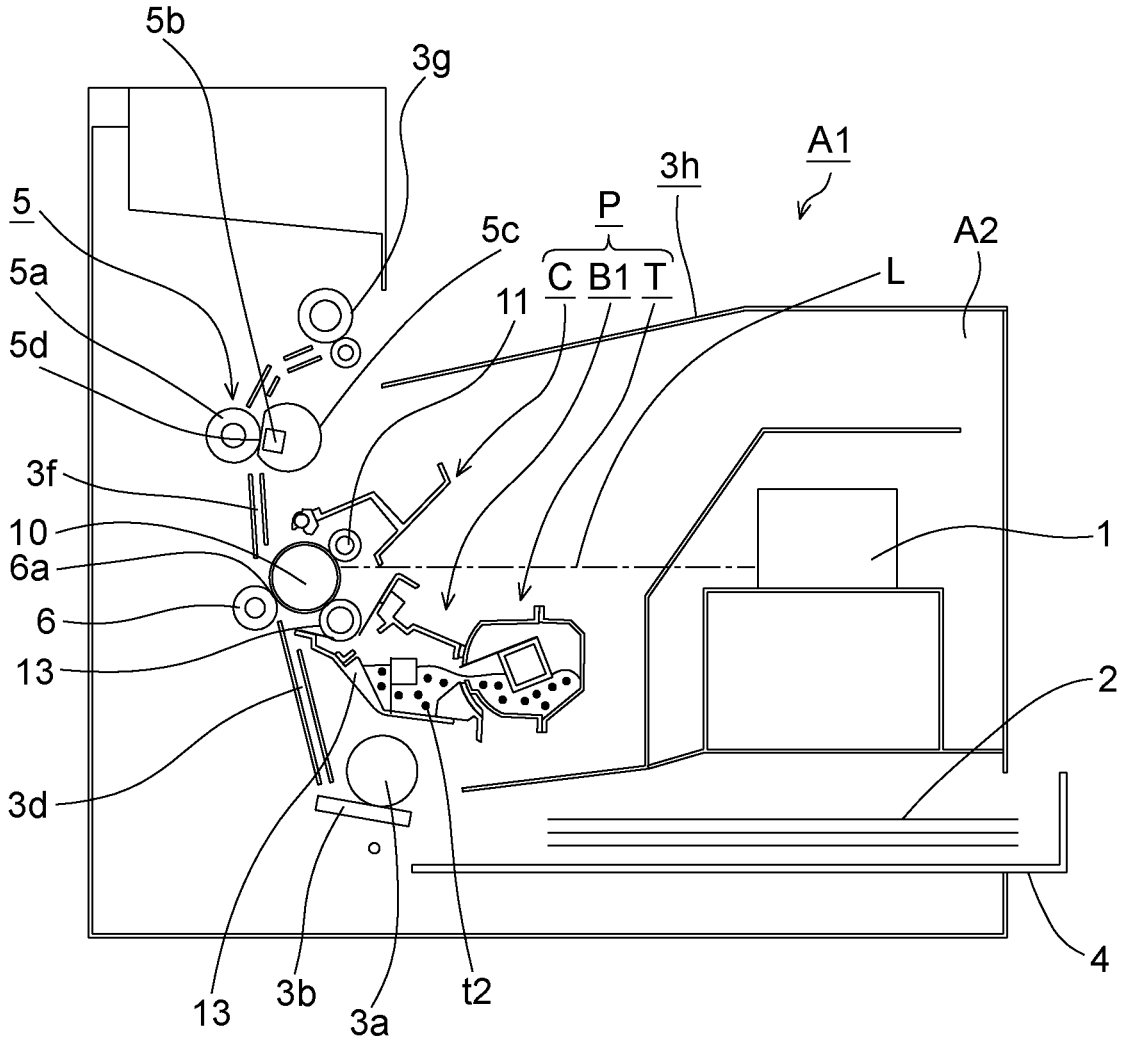
FIG. 2 is a schematic sectional view of an image forming apparatus.
Figure 3:
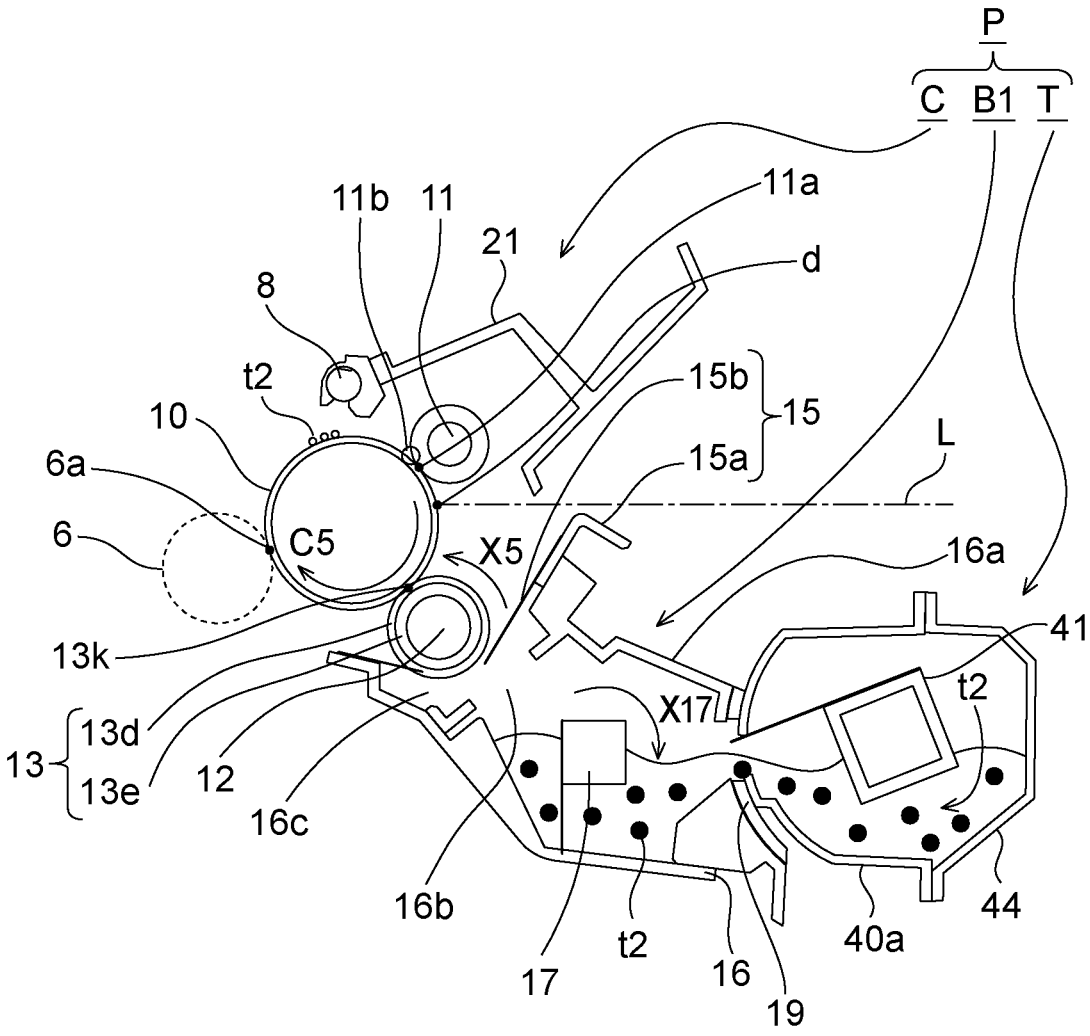
FIG. 3 is a schematic sectional view of the process cartridge.

First, an overall configuration of the image forming apparatus A1 to which an embodiment of the disclosure is applied will be described with reference to FIG. 2. FIG. 2 is a schematic sectional view of the image forming apparatus A1 and a sectional surface thereof is orthogonal to the rotational axis L1 of the photosensitive drum 10. FIG. 3 is a schematic sectional view of the process cartridge P and a sectional surface thereof is orthogonal to the rotational axis L1 of the photosensitive drum 10.

The image forming apparatus A1 illustrated in FIG. 2 forms an image with toner t2 on a recording medium 2 by an electrophotographic image forming process in accordance with image information communicated from an external device such as a personal computer. Examples of the recording medium 2 include a recording sheet of paper, a label sheet of paper, an OHP sheet, cloth, and the like. The process cartridge P in which the development unit B1 and the photosensitive member unit C are integrated is able to be attached to or detached from the apparatus main body A2 of the image forming apparatus A1 by a user.

As illustrated in FIG. 3, the development unit B1 includes a developer container 16 as a development frame in which the development roller (development member) 13, a development blade 15, and the like are provided. The photosensitive member unit C includes a cleaning frame 21 in which the photosensitive drum 10, a charging roller (charging member) 11, and the like are provided.

A toner bottle (developer unit) T is detachably attached to an attaching portion (developer unit attaching portion) 19 of the development unit B1. The toner t2 to be supplied to the development unit B1 is contained in the toner bottle T.

The toner t2 contained in a developer containing portion 16*a* of the developer container 16 is fed from an opening 16*b* of the developer container 16 into a development chamber 16*c* when a developer feeding member 17 which is rotatably supported in the developer container 16 rotates in a direction of an arrow X17. The development roller 13 in which a magnet roller 12 is built is provided in the developer container 16. Specifically, the development roller 13 is constituted by an axis portion 13*e* and a rubber portion 13*d*. The axis portion 13*e* is a slender electroconductive cylinder of aluminum or the like, and a middle part thereof in the longitudinal direction is covered with the rubber portion 13*d*. Here, the rubber portion 13*d* covers the axis portion 13*e* so that an outer shape thereof is coaxial with the axis portion 13*e*. The development roller 13 attracts the toner t2 in the development chamber 16*c* to a surface of the development roller 13 by a magnetic force of the magnet roller 12. The development blade 15 is constituted by a support member 15*a* made of a metal plate and an elastic member 15*b* made from urethane rubber, an SUS plate, or the like, and is provided so that the elastic member 15*b* elastically contacts the development roller 13 with constant contact pressure. Rotation of the development roller 13 in a rotation direction X5 regulates an amount of the toner t2 bonded to the surface of the development roller 13, and imparts a triboelectric charge to the toner t2. Thereby, a toner layer is formed on the surface of the development roller 13. When the development roller 13 to which a voltage is applied from the apparatus main body A2 of the image forming apparatus A1 rotates in the rotation direction X5 while contacting the photosensitive drum 10, the toner t2 is supplied to a development region on the photosensitive drum 10.

The charging roller 11 that is rotatably supported by the cleaning frame 21 and is urged in a direction of the photosensitive drum 10 is provided in contact with an outer peripheral surface of the photosensitive drum 10. The charging roller 11 uniformly charges a surface of the photosensitive drum 10 by application of a voltage from the apparatus main body A2 of the image forming apparatus A1. The voltage to be applied to the charging roller 11 is set to a value by which a potential difference between the surface of the photosensitive drum 10 and the charging roller 11 is equal to or greater than a discharge start voltage. Specifically, a direct current voltage of −1300 V is applied as a charging bias. At this time, the surface of the photosensitive drum 10 is uniformly contact-charged to have a charged potential (dark portion potential) of −700 V. Then, a laser beam L that is emitted from a laser scanner 1 (FIG. 2) and corresponds to image information forms an electrostatic latent image on the surface of the photosensitive drum 10. After that, the toner t2 is transferred in accordance with the electrostatic latent image on the photosensitive drum 10 to form a visible image of the electrostatic latent image, thereby forming a developed image on the photosensitive drum 10.

On the other hand, each recording medium 2 accommodated in a sheet feed tray 4 is separated and fed one by one by being regulated by a sheet feeding roller 3*a* and a separation pad 3*b*, which is in a pressure contact with the paper feeding roller 3*a*, in synchronization with formation of the developed image. Then, a conveyance guide 3*d* conveys the recording medium 2 to a transfer roller 6 serving as a transfer unit. The transfer roller 6 is urged so as to contact the surface of the photosensitive drum 10.

Next, the recording medium 2 passes through a transfer nip portion 6*a* formed by the photosensitive drum 10 and the transfer roller 6. At this time, a voltage having a polarity opposite to that of the developed image is applied to the transfer roller 6, so that the developed image formed on the surface of the photosensitive drum 10 is transferred onto the recording medium 2.

The recording medium 2 onto which the developed image is transferred is regulated by a conveyance guide 3*f* and conveyed to a fixing unit 5. The fixing unit 5 includes a driving roller 5*a* and a fixing roller 5*c* in which a heater 5*b* is built. Heat and pressure are applied to the recording medium 2 when passing through a nip portion 5*d* formed by the driving roller 5*a* and the fixing roller 5*c*, and the developed image transferred onto the recording medium 2 is fixed to the recording medium 2. Thereby, an image is formed on the recording medium 2. Thereafter, the recording medium 2 is conveyed by a discharge roller pair 3*g* and discharged to a discharge portion 3*h*.

<Development Unit B1>

Figure 4A:
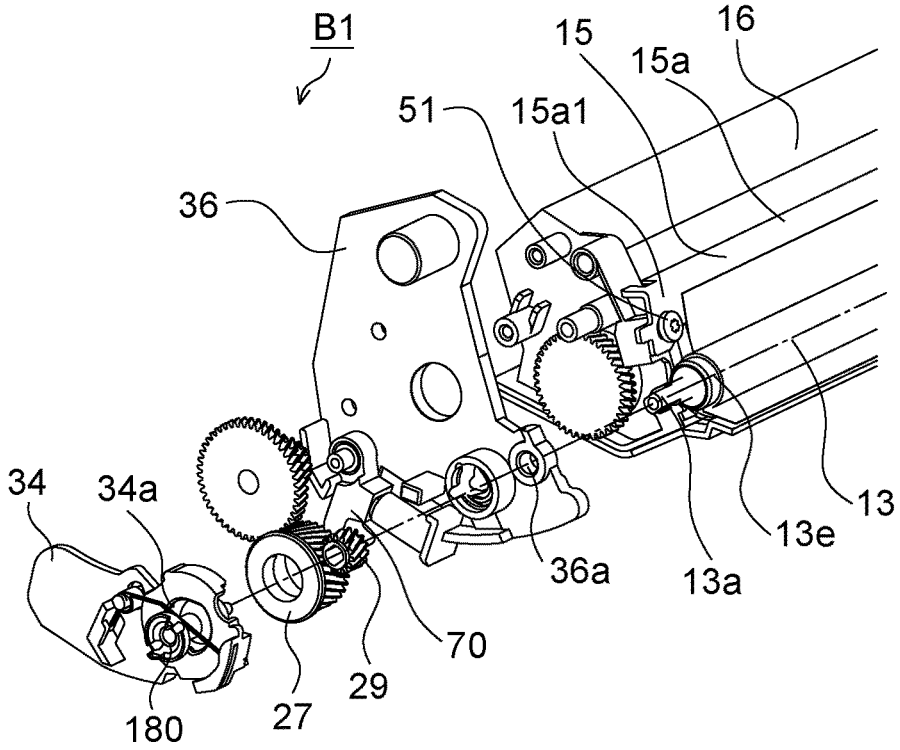
FIG. 4A is an exploded perspective view of a driving side part of a development unit as seen from a driving side and FIG. 4B is an exploded perspective view of the driving side part of the development unit as seen from a non-driving side.
Figure 4B:
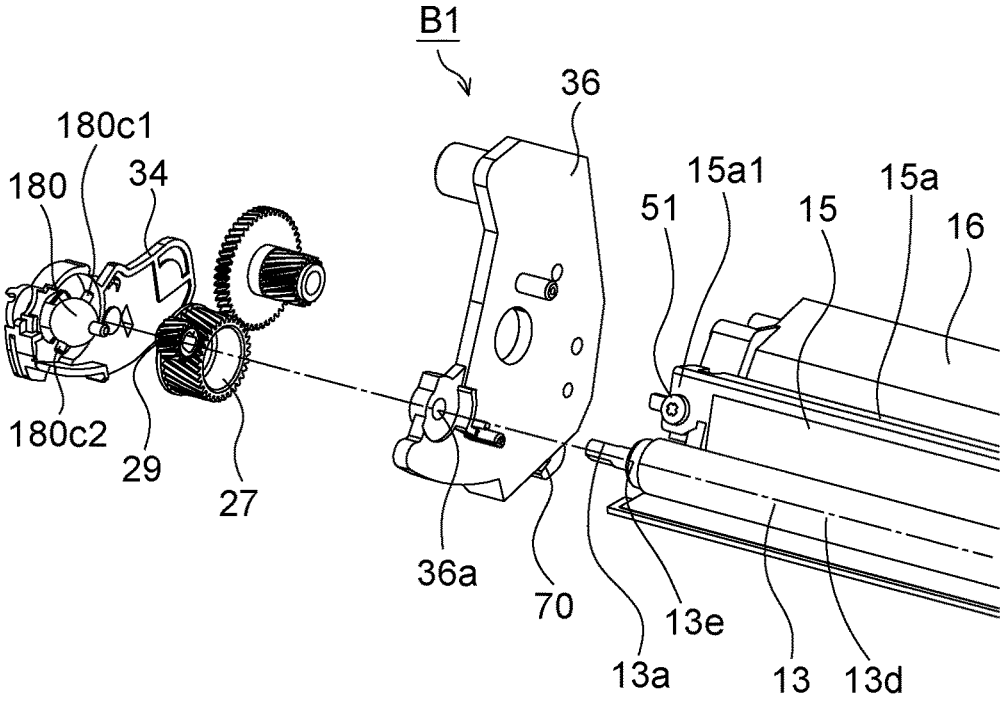
Figure 5A:
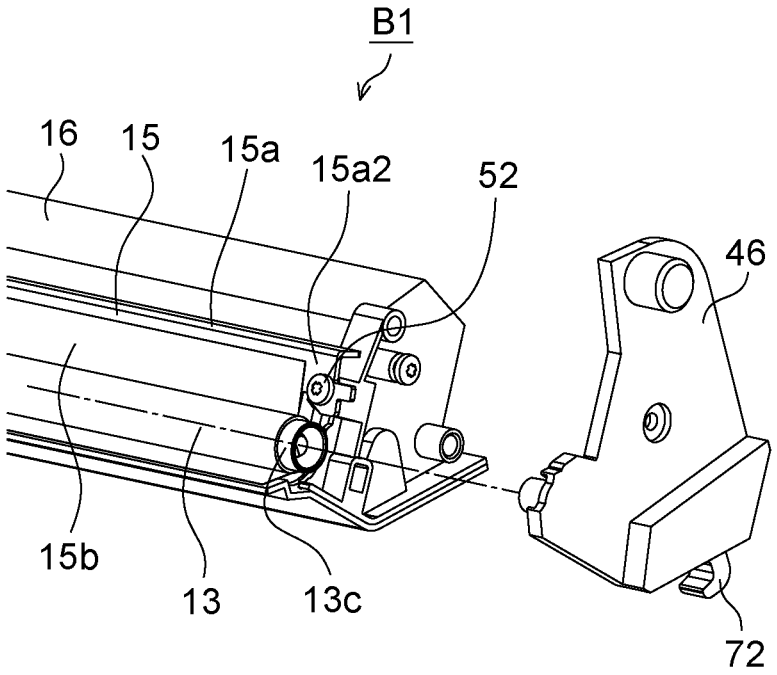
FIG. 5A is an exploded perspective view of a non-driving side part of the development unit as seen from the non-driving side and FIG. 5B is an exploded perspective view of the non-driving side part of the development unit as seen from the driving side.
Figure 5B:
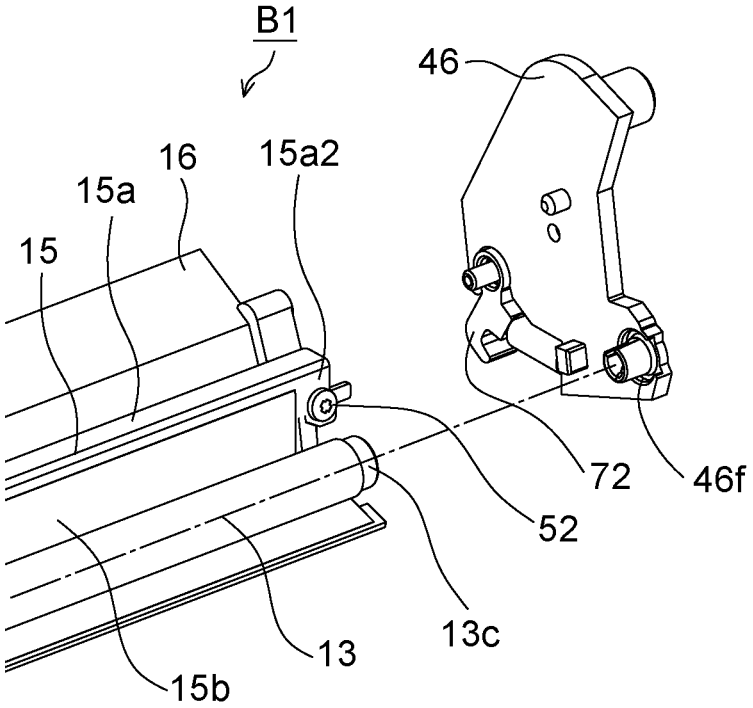
Figure 6A:
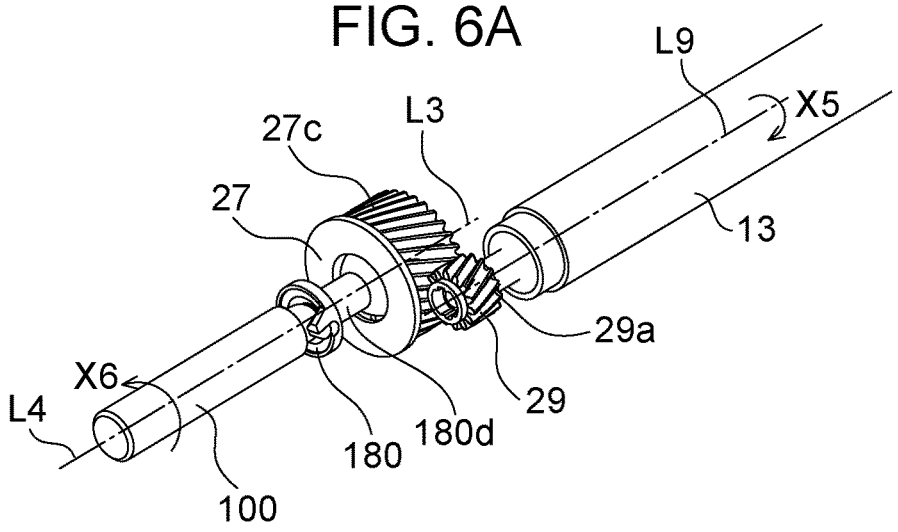
FIGS. 6A to 6E illustrate assembling of a development side cover to a driving side development bearing.
Figure 6B:
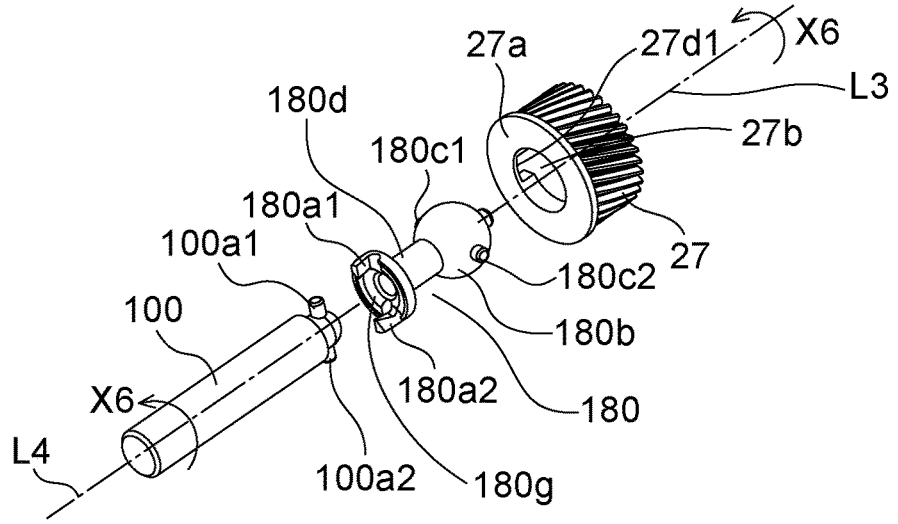
Figure 6C:
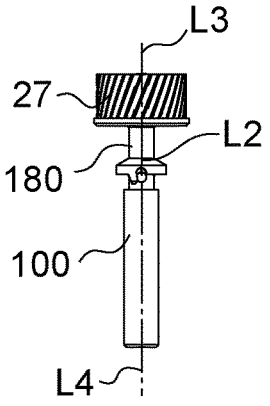
Figure 6D:
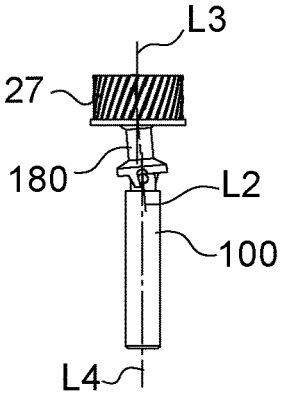
Figure 6E:
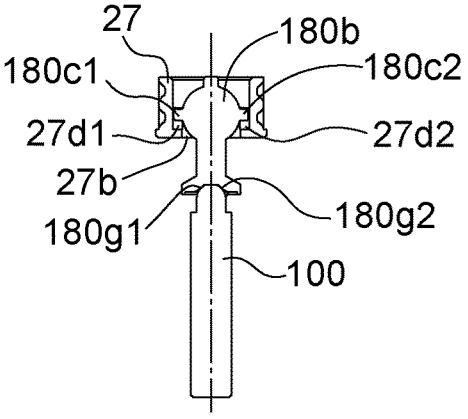

Next, a configuration of the development unit B1 will be described with reference to FIGS. 4A and 4B and 5A and 5B. In the following description, a side in the longitudinal direction in which a rotary force is transmitted from the apparatus main body A2 of the image forming apparatus A1 to the development unit B1 is referred to as a "driving side". The opposite side in the longitudinal direction is referred to as a "non-driving side". FIG. 4A is an exploded perspective view of a driving side part of the development unit B1 as seen from the driving side and FIG. 4B is an exploded perspective view of the driving side part of the development unit B1 as seen from the non-driving side. FIG. 5A is an exploded perspective view of a non-driving side part of the development unit B1 as seen from the non-driving side and FIG. 5B is an exploded perspective view of the non-driving side part of the development unit B1 as seen from the driving side. FIGS. 6A to 6E illustrate a configuration of driving force transmission to the development unit B1. FIG. 6A is a perspective view, FIG. 6B is a perspective view, FIG. 6C is a view as seen from a direction orthogonal to a rotational axis L3, FIG. 6D is a view as seen from the direction orthogonal to the rotational axis L3, and FIG. 6E is a sectional view as seen from the direction orthogonal to the rotational axis L3.

As illustrated in FIGS. 4A and 4B and 5A and 5B, the development unit B1 includes the development roller 13, the development blade 15, and the like. In the development blade 15, a driving side end portion 15*a*1 and a non-driving side end portion 15*a*2 in the longitudinal direction of the support member 15*a* are fixed to the developer container 16 by a screw 51 and a screw 52, respectively. A driving side development bearing 36 and a non-driving side development bearing 46 are provided at end portions of the developer container 16 in the longitudinal direction. A driving side end portion 13*a* fits into a hole 36*a* of the driving side development bearing 36, and a non-driving side end portion 13*c* fits into a support portion 46*f* of the non-driving side development bearing 46, so that the development roller 13 is rotatably supported. At the driving side end portion 13*a* of the development roller 13, a development roller gear 29 is disposed coaxially with the development roller 13 and further outward from the driving side development bearing 36 in the longitudinal direction, so that the development roller 13 and the development roller gear 29 are engaged with each other so as to be rotatable integrally.

The driving side development bearing 36 rotatably supports a driving force input gear 27 at an outer side thereof in the longitudinal direction. The driving force input gear 27 meshes with the development roller gear 29.

A coupling member (rotary force receiving member) 180 is provided coaxially with the driving force input gear 27. A development side cover 34 is provided at the outermost end portion of the driving side of the development unit B1 so as to cover the driving force input gear 27 and the like from the outer side in the longitudinal direction. The coupling member 180 protrudes to the outside in the longitudinal direction through a hole 34*a* in the development side cover 34. Although described in detail below, the coupling member 180 is configured to be engaged with a main body side driving member 100 (FIGS. 6A to 6E) provided in the apparatus main body A2 of the image forming apparatus A1, so that a rotary force is transmitted. The configuration is such that the rotary force is transmitted to a rotary force transmission-receiving portion 27*d*1 (refer to FIG. 6B) and a rotary force transmission-receiving portion 27*d*2 of the driving force input gear 27 via rotary force transmitting portions 180c1 and 180c2 of the coupling member 180. As a result, the configuration is such that the rotary force input to the coupling member 180 is transmitted to the development roller 13 serving as a rotary member via the driving force input gear 27 and the development roller gear 29.

The driving side development bearing 36 includes a driving side contacting spacing lever 70. The non-driving side development bearing 46 includes a non-driving side contacting/spacing lever 72.

<Coupling Member 180 and Peripheral Configuration Thereof>

Next, the coupling member 180 and a peripheral configuration thereof will be described in detail below. As illustrated in FIGS. 6A to 6E, the coupling member 180, the driving force input gear 27, and a coupling spring 185 (refer to FIGS. 7A and 7B) are provided on the driving side of the development unit B1. The coupling member 180 is engaged with the main body side driving member 100 provided in the apparatus main body A2 of the image forming apparatus A1, so that the rotary force is transmitted.

Specifically, as illustrated in FIG. 6B, the coupling member 180 is mainly constituted by a rotary force receiving portion 180a1, a rotary force receiving portion 180a2, a supported portion 180b, the rotary force transmitting portion 180c1, a guided portion 180d, and the rotary force transmitting portion 180c2. The rotary force receiving portion 180a1 and the rotary force receiving portion 180a2 of the coupling member 180 are disposed outside a driving side end portion 27a of the driving force input gear 27 in the longitudinal direction. When the main body side driving member 100 rotates in a direction of an arrow X6 around a rotational axis L4, a rotary force applying portion 100a1 of the main body side driving member 100 contacts the rotary force receiving portion 180a1, and a rotary force applying portion 100a2 of the main body side driving member 100 contacts the rotary force receiving portion 180a2. Thereby, the rotary force is transmitted from the main body side driving member 100 to the coupling member 180.

As illustrated in FIGS. 6B and 6E, the supported portion 180b of the coupling member 180 is substantially spherical and the supported portion 180b is supported by a support portion 27b on an inner peripheral surface of the driving force input gear 27. The rotary force transmitting portion 180c1 and the rotary force transmitting portion 180c2 are provided in the supported portion 180b of the coupling member 180. The rotary force transmitting portion 180c1 contacts the rotary force transmission-receiving portion 27d1 of the driving force input gear 27. Similarly, the rotary force transmitting portion 180c2 contacts the rotary force transmission-receiving portion 27d2 of the driving force input gear 27. Thereby, the driving force input gear 27 is driven by the coupling member 180 that receives driving from the main body side driving member 100 and the driving force input gear 27 rotates in a forward rotation direction X6 around the rotary axis L3.

As illustrated in FIG. 6C, the rotational axis L4 of the main body side driving member 100 is set to be coaxial with the rotational axis L3 of the driving force input gear 27. However, for example, due to unevenness in dimensions of components, the rotational axis L4 of the main body side driving member 100 and the rotational axis L3 of the driving force input gear 27 may be slightly deviated in parallel from the co-axis as illustrated in FIG. 6D. In such a case, rotation is performed in a state where the rotational axis L2 of the coupling member 180 is inclined relative to the rotational axis L3 of the driving force input gear 27, and the rotary force is transmitted from the main body side driving member 100 to the coupling member 180. Further, the rotational axis L3 of the driving force input gear 27 may be slightly deviated with an angle from the co-axis relative to the rotational axis L4 of the main body side driving member 100. In such a case, the rotary force is transmitted from the main body side driving member 100 to the coupling member 180 in a state where the rotational axis L2 of the coupling member 180 is inclined relative to the rotational axis L4 of the main body side driving member 100.

In addition, as illustrated in FIG. 6A, the driving force input gear 27 is provided integrally with a gear portion 27c which is a helical gear or a spur gear and coaxially with the rotational axis L3 of the driving force input gear 27. The gear portion 27c is engaged with a gear portion 29a of the development roller gear 29. Since the development roller gear 29 rotates integrally with the development roller 13, the rotary force of the driving force input gear 27 is transmitted to the development roller 13 through the development roller gear 29. Then, the development roller 13 rotates in the rotation direction X5 around the rotational axis L9.

<Assembling of Development Side Cover 34>

Figure 7A:
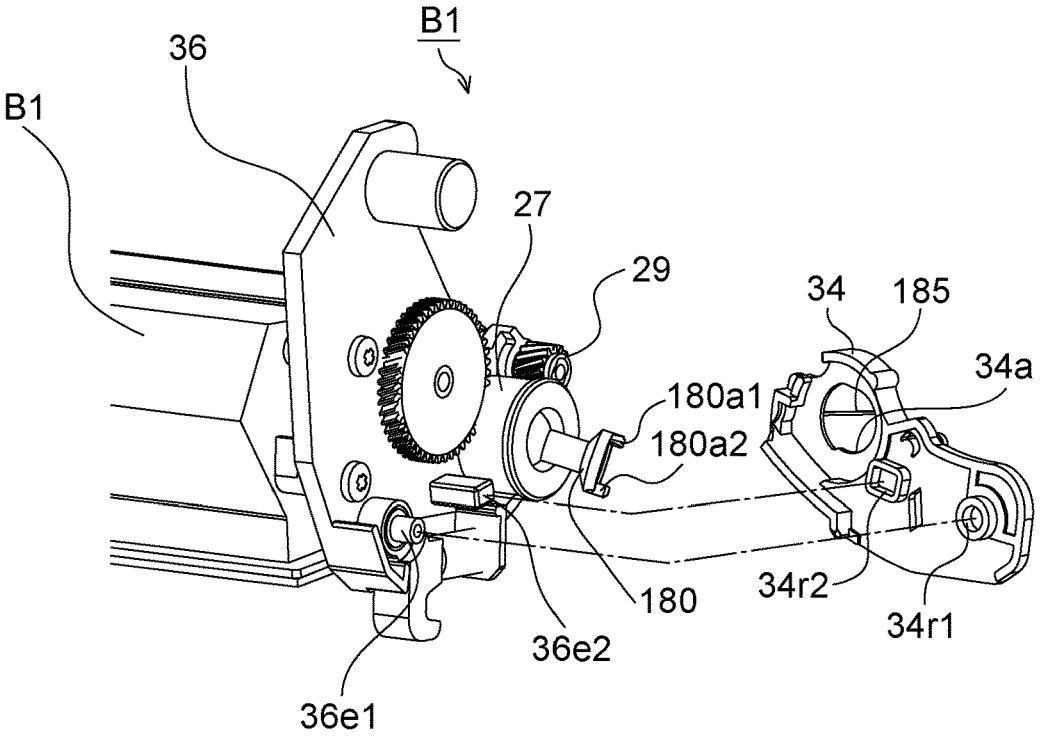
FIGS. 7A and 7B are exploded perspective views of the driving side of the development unit.
Figure 7B:
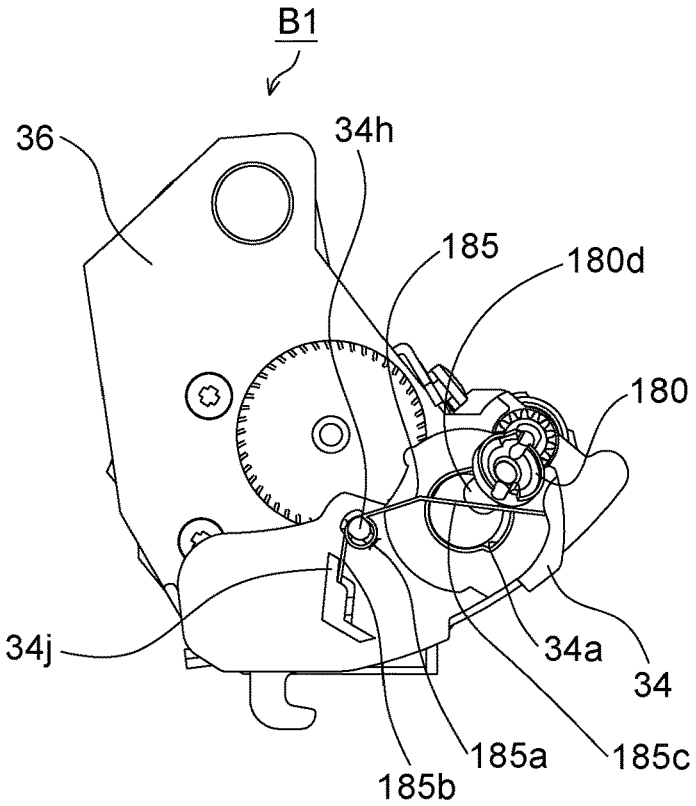

FIGS. 7A and 7B illustrate assembling of the development side cover 34 to the driving side development bearing 36, and FIG. 7A is an exploded perspective view and FIG. 7B is a side view as seen from the rotational axis L9 of the development roller 13. As illustrated in FIGS. 7A and 7B, the development side cover 34 is fixed outside the driving side development bearing 36 with respect to the longitudinal direction. Specifically, a positioning portion 34r1 of the development side cover 34 and a positioned portion 36e1 of the driving side development bearing 36 are engaged with each other and a positioning portion 34r2 and a positioned portion 36e2 are engaged with each other, so that a position of the development side cover 34 is decided relative to the driving side development bearing 36. Note that, as a fixing method of the development side cover 34 to the driving side development bearing 36, a screw, an adhesive, or the like may be used, and a configuration thereof is not limited.

When the development side cover 34 is assembled, the rotary force receiving portion 180a1, the rotary force receiving portion 180a2, the guided portion 180d, and the like of the coupling member 180 are exposed through the hole 34a of the development side cover 34 to the outside with respect to the longitudinal direction of the development unit B1. The coupling spring 185 is attached to the development side cover 34. The coupling spring 185 is a twisted coil spring and has one end in contact with the development side cover 34 and the other end in contact with the coupling member 180. Specifically, a positioning portion 185a of the coupling spring 185 is supported by a spring support portion 34h of the development side cover 34. A fixed arm 185b of the coupling spring 185 is fixed to a spring engagement portion 34j of the development side cover 34. An operation arm 185c of the coupling spring 185 is configured to contact the guided portion 180d of the coupling member 180.

<Photosensitive Member Unit C>

Figure 8A:
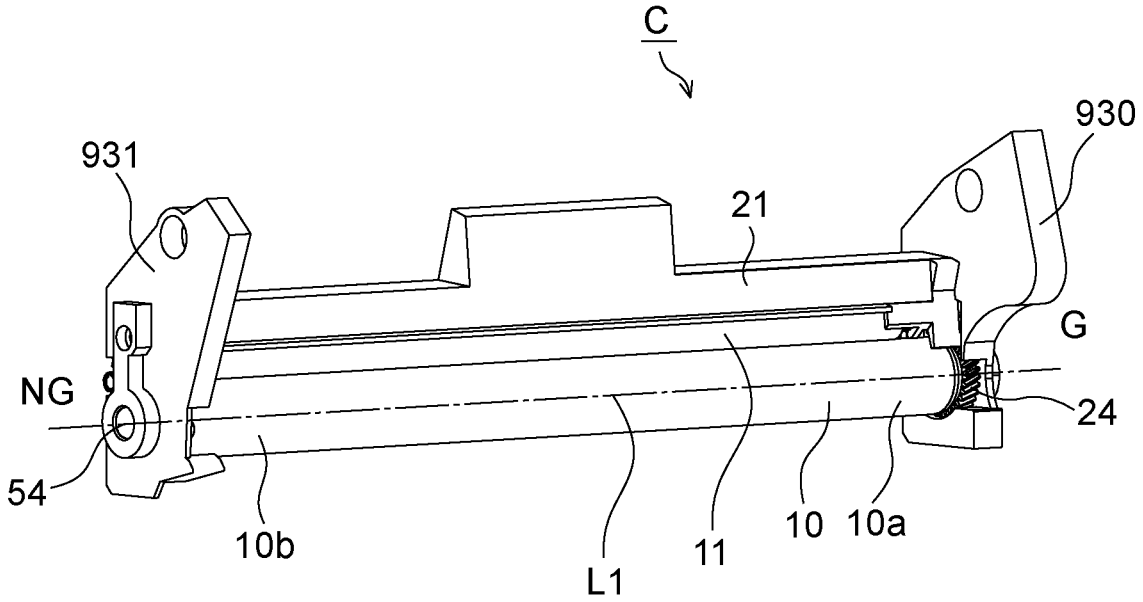
FIGS. 8A and 8B are perspective views of a photosensitive member unit.
Figure 8B:
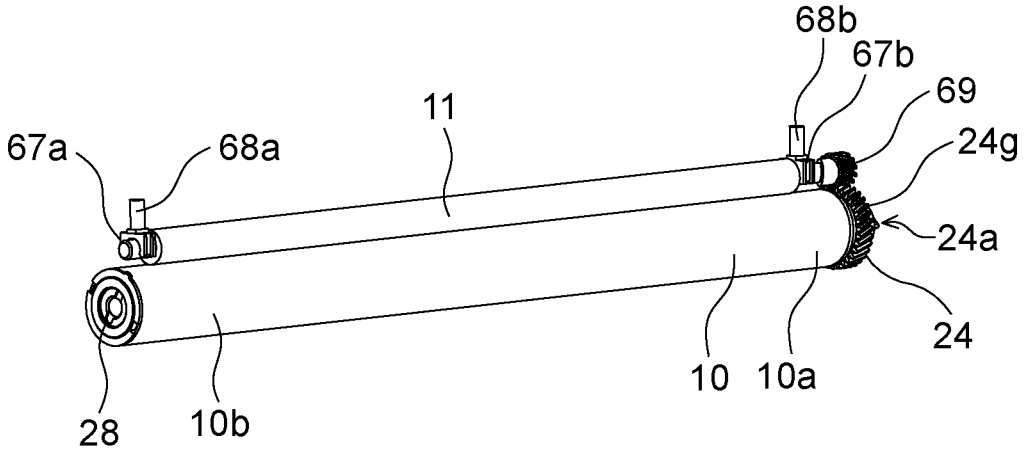

Next, a configuration of the photosensitive member unit C will be described with reference to FIGS. 8A and 8B. FIG. 8A is a perspective view of the photosensitive member unit C as seen from a non-driving side NG. FIG. 8B is a perspective view in which the cleaning frame 21, a drum bearing member (support member) 930, a drum shaft 54, and the like are not illustrated for explanation of peripheral portions of the photosensitive drum 10 and the charging roller 11. As illustrated in FIGS. 8A and 8B, the photosensitive member unit C includes the photosensitive drum 10, the charging roller 11, and the like. The cleaning frame 21, the drum bearing member 930, and a drum bearing member 931 form a frame of the photosensitive member unit C. The charging roller 11 is rotatably supported by a charging roller bearing 67*a* and a charging roller bearing 67*b* and is urged toward the photosensitive drum 10 by a charging roller urging member 68*a* and a charging roller urging member 68*b*. The charging roller 11 is supported by the cleaning frame 21 through the charging roller bearing 67*a*, the charging roller bearing 67*b*, the charging roller urging member 68*a*, and the charging roller urging member 68*b*.

A driving side flange 24 is integrally fixed to a driving side end portion 10*a* of the photosensitive drum 10, and a non-driving side flange 28 is integrally fixed to a non-driving side end portion 10*b* of the photosensitive drum 10. The driving side flange 24 and the non-driving side flange 28 are fixed coaxially with the photosensitive drum 10 by means of clamping, bonding, or the like. At both longitudinal end portions of the cleaning frame 21, the drum bearing member 930 is fixed to an end portion on a driving side G and the drum bearing member 931 is fixed to an end portion on the non-driving side NG by means of screws, bonding, press-fitting, or the like. In the photosensitive drum 10, the driving side flange 24 and the non-driving side flange 28 that are integrally fixed to the photosensitive drum 10 are rotatably supported by the drum shaft 54 that is fixed by the drum bearing member 930 and the drum bearing member 931.

A charging roller gear 69 is fixed to one longitudinal end of the charging roller 11 and the charging roller gear 69 is engaged with a gear portion 24*g* of the driving side flange 24. A driving side end portion 24*a* of the driving side flange 24 is configured to receive the rotary force from the side of the apparatus main body A2 of the image forming apparatus A1 (not illustrated). Therefore, as the photosensitive drum 10 is driven to rotate, the charging roller 11 is also driven to rotate. As described above, a peripheral speed of the surface of the charging roller 11 is set to be about 105 to 120% relative to a peripheral speed of the surface of the photosensitive drum 10.

<Coupling Lever 955>

Figure 9A:
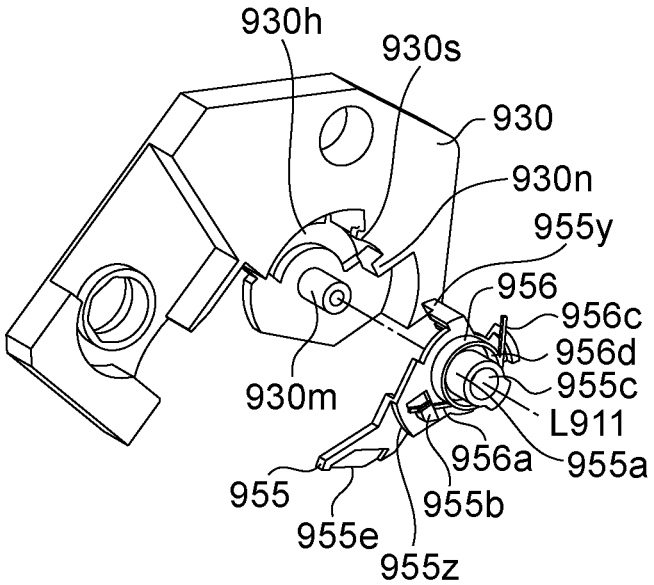
FIGS. 9A to 9D are views for explaining configurations of a coupling lever and a coupling lever spring and assembling of the coupling lever and the coupling lever spring to a drum bearing member.
Figure 9B:
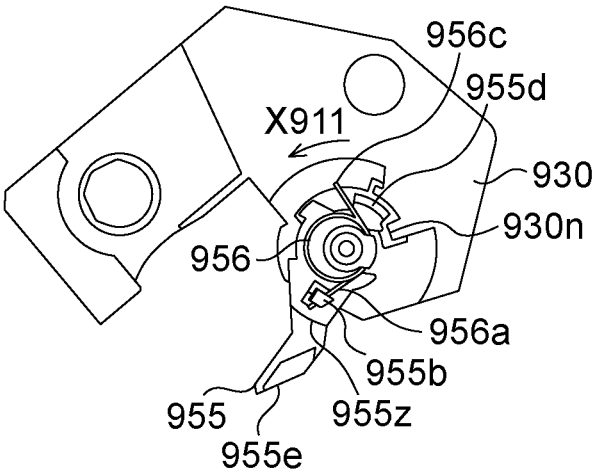
Figure 9C:
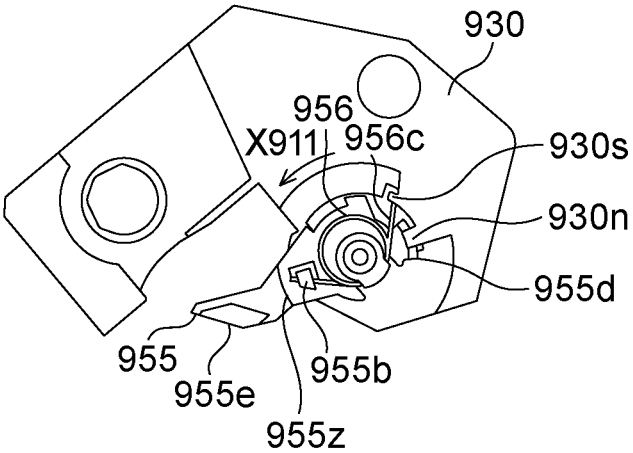
Figure 9D:
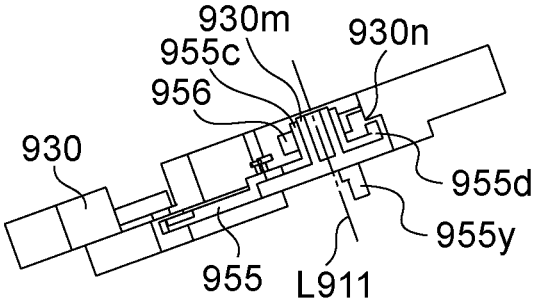

Configurations of a coupling lever 955 as a regulating member and a coupling lever spring 956 and assembling of the coupling lever 955 and the coupling lever spring 956 to the drum bearing member 930 will be described. FIGS. 9A to 9D are views for explaining the configurations of the coupling lever 955 and the coupling lever spring 956 and assembling of the coupling lever 955 and the coupling lever spring 956 to the drum bearing member 930. FIG. 9A is a perspective view, FIG. 9B is a side view as seen from a direction of a rotational axis L911, FIG. 9C is a side view as seen from the direction of the rotational axis L911, and FIG. 9D is a view as seen from a direction orthogonal to the rotational axis L911.

As illustrated in FIGS. 9A to 9D, the coupling lever 955 and the coupling lever spring 956 are assembled to an inner side of the drum bearing member 930 in the longitudinal direction of the process cartridge P. Specifically, a lever positioning boss (support portion) 930*m* in a cylindrical shape of the drum bearing member 930 fits into a hole portion 955*c* of the coupling lever 955 and the coupling lever 955 is supported rotatably relative to the drum bearing member 930 about the rotational axis L911. The coupling lever spring 956 is a twisted coil spring and has one end engaged with the coupling lever 955 and the other end engaged with the drum bearing member 930. That an operation arm 956*a* of the coupling lever spring 956 is engaged with a spring hook portion 955*b* of the coupling lever 955. A fixed arm 956*c* of the coupling lever spring 956 is engaged with a spring hook portion 930*s* of the drum bearing member 930 (refer to FIG. 9C). Accordingly, the coupling lever 955 is rotatable about the rotational axis L911 that is decided by the lever positioning boss 930*m* and is always urged in a direction of an arrow X911 by the coupling lever spring 956.

A method of assembling the coupling lever 955 and the coupling lever spring 956 to the drum bearing member 930 will be described in order. First, a positioning portion 956*d* of the coupling lever spring 956 is placed coaxially with a cylindrical boss 955*a* of the coupling lever 955 (FIG. 9A). At this time, the operation arm 956*a* of the coupling lever spring 956 is engaged with the spring hook portion 955*b* of the coupling lever 955. In addition, the fixed arm 956*c* of the coupling lever spring 956 is deformed in the direction of the arrow X911 about the rotational axis L911. Then, the hole portion 955*c* of the coupling lever 955 is inserted into the lever positioning boss 930*m* of the drum bearing member 930 (FIGS. 9A and 9B). In the insertion, a retaining portion 955*d* of the coupling lever 955 and a portion-to-be-retained 930*n* of the drum bearing member 930 are arranged so as not to be interfered with each other. Specifically, as illustrated in FIG. 9B, the retaining portion 955*d* of the coupling lever 955 and the portion-to-be-retained 930*n* of the drum bearing member 930 are arranged so as not to be overlapped with each other as seen from the longitudinal direction.

In a state illustrated in FIG. 9B, as described above, the fixed arm 956*c* of the coupling lever spring 956 is deformed in the direction of the arrow X911. A configuration is such that when the deformation of the fixed arm 956*c* of the coupling lever spring 956 is released from the state illustrated in FIG. 9B, the fixed arm 956*c* is engaged with the spring hook portion 930*s* of the drum bearing member 930, as illustrated in FIG. 9C (refer to FIGS. 9C and 9D). By the foregoing, the assembling of the coupling lever 955 and the coupling lever spring 956 to the drum bearing member 930 ends and the coupling lever 955 is brought into a state of being supported movably (rotatably about the rotational axis L911) with respect to the drum bearing member 930.

An opening 930*h* (refer to FIG. 9A) is provided in the drum bearing member 930 so that a rotation regulating portion 955*y* (refer to FIG. 9A) of the coupling lever 955 does not interfere the drum bearing member 930. When the coupling lever 955 is assembled to the drum bearing member 930, the rotation regulating portion 955*y* is inserted into the opening 930*h*. When the assembling of the coupling lever 955 to the drum bearing member 930 is completed, the rotation regulating portion 955*y* is brought into a state of protruding from a surface of the drum bearing member 930 in the direction of the rotational axis L911 as illustrated in FIG. 9D.

At this time, the retaining portion 955*d* of the coupling lever 955 is brought into a state of being overlapped with the portion-to-be-retained 930*n* of the drum bearing member 930 as seen along the longitudinal direction of the process cartridge P. That is, a configuration is such that the movement of the coupling lever 955 in the longitudinal direction is regulated and only the rotation about the rotational axis L911 is permitted.

Although described in detail below, the coupling lever 955 is provided with a regulating portion 955*z* that partially contacts the development unit B1 to thereby suppress excess movement of the development unit B1.

<Coupling of Development Unit B1 and Photosensitive Member Unit C>

Figure 10A:
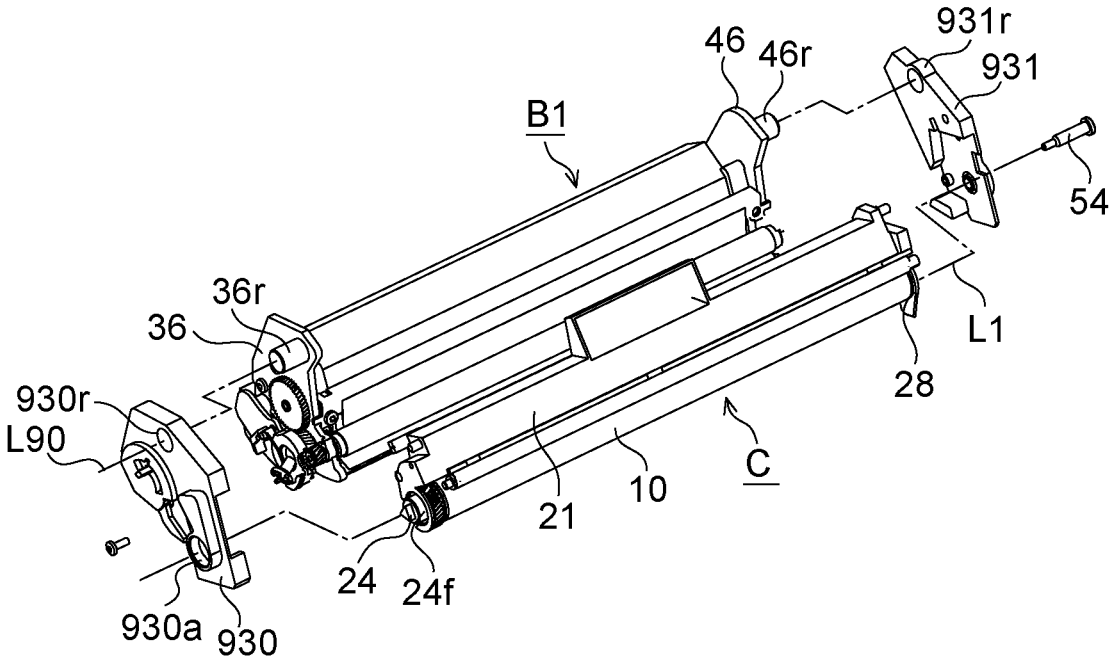
FIGS. 10A and 10B are exploded perspective views of the process cartridge.
Figure 10B:
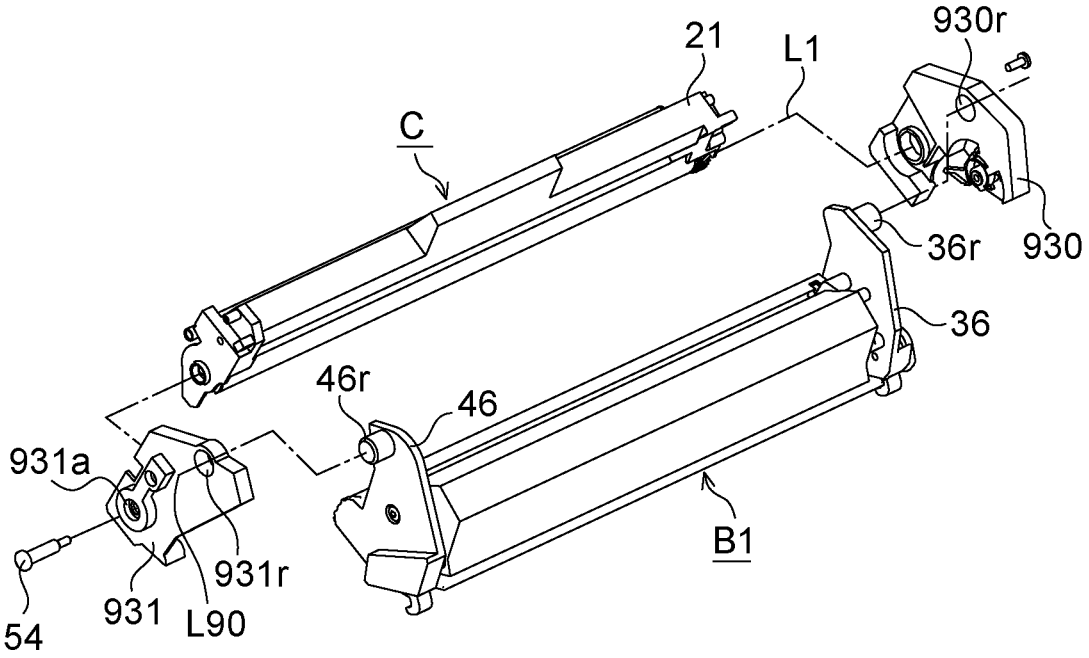

Next, a configuration in which the development unit B1 and the photosensitive member unit C are coupled to form the process cartridge P will be described. FIGS. 10A and 10B are exploded perspective views of the process cartridge P, and FIG. 10A is an exploded perspective view as seen from the driving side and FIG. 10B is an exploded perspective view as seen from the non-driving side.

As illustrated in FIGS. 10A and 10B, at both longitudinal end portions of the cleaning frame 21, the drum bearing member 930 is fixed to an end portion on the driving side and the drum bearing member 931 is fixed to an end portion on the non-driving side by means of screws, bonding, press-fitting, or the like. A supported portion 24*f* of the driving side flange 24 that is integrally fixed to the photosensitive drum 10 is rotatably supported by a hole portion 930*a* of the drum bearing member 930. Moreover, a supported portion 28*f* (not illustrated) of the non-driving side flange 28 is rotatably supported coaxially with a hole portion 931*a* of the drum bearing member 931 by the drum shaft 54.

Further, in the development unit B1, a hang boss (first coupling portion) 36*r* provided on the driving side development bearing 36 fits into a hang hole (second coupling portion) 930*r* provided in the drum bearing member 930 to be rotatably supported. In addition, a hang boss 46*r* provided on the non-driving side development bearing 46 is rotatably supported by a hang hole 931*r* provided in the drum bearing member 931. With such configurations, the development unit B1 is configured to be swingable relative to the photosensitive member unit C with the hang boss 36*r* of the driving side development bearing 36 and the hang boss 46*r* of the non-driving side development bearing 46 as an axis L90 (FIGS. 10A and 10B). At this time, the development unit B1 in a free state (spontaneous state) is always urged toward the photosensitive member unit C by a development urging member (development unit urging member) that is a twisted coil spring (not illustrated) so that the development roller 13 contacts the photosensitive drum 10. As a method of urging the development unit B1, a method of providing a spring between the photosensitive member unit C and the development unit B1 and a method of utilizing weight of the development unit B1 per se are considered, but the method is not limited.

<Attitude of Coupling Member 180>

Figure 11A:
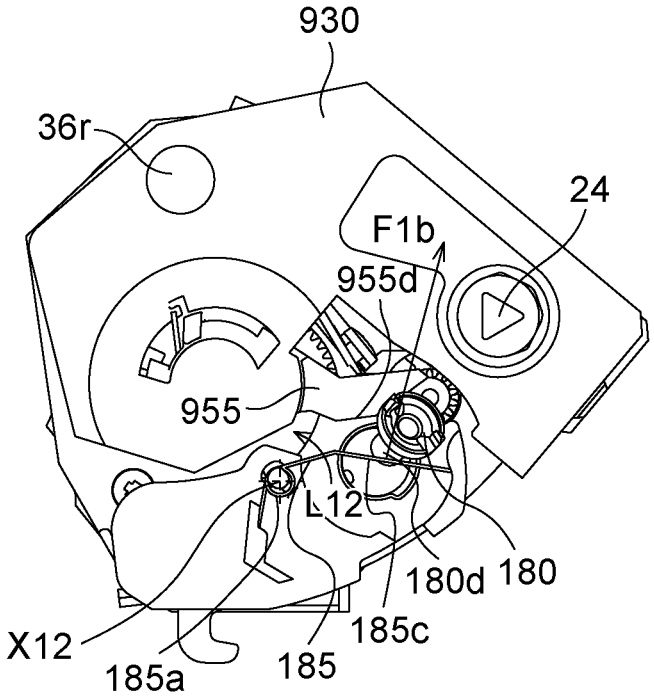
FIG. 11A is a side view of the process cartridge.
Figure 11B:
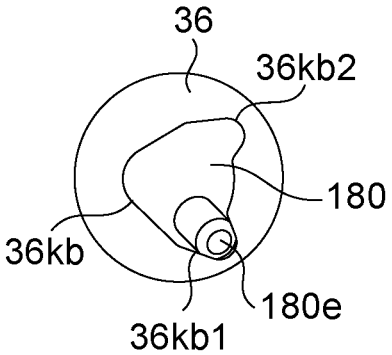
FIG. 11B illustrates a relation between a phase regulating boss and the driving side development bearing.
Figure 11C:
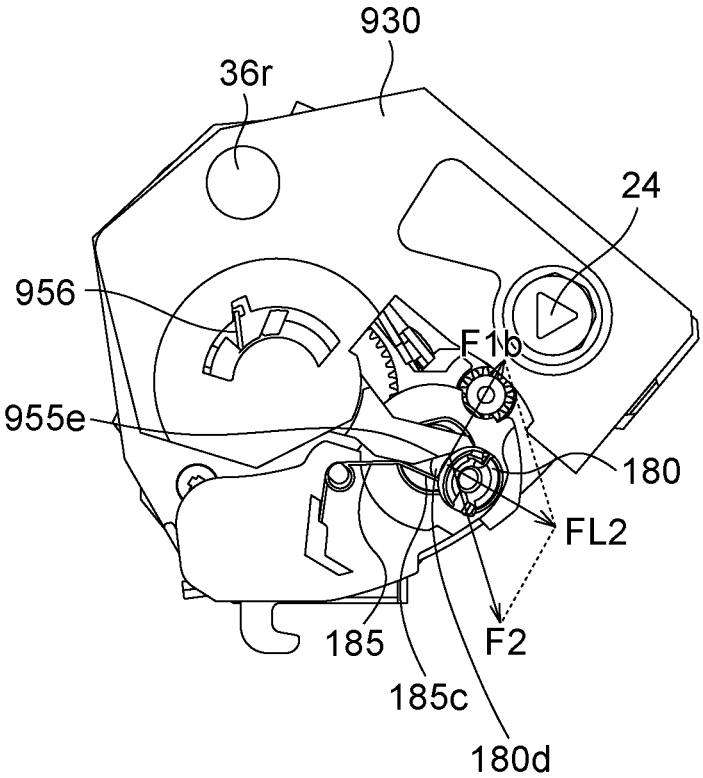
FIG. 11C is a side view of the process cartridge.
Figure 11D:
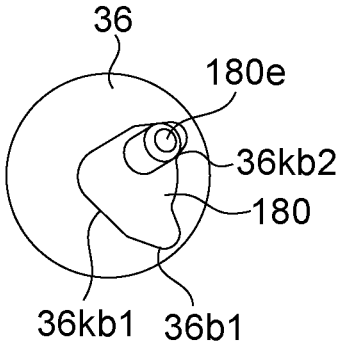
FIG. 11D illustrates a relation between the phase regulating boss and the driving side development bearing.

Next, an attitude of the coupling member 180 will be described. FIGS. 11A and 11C are side views of the process cartridge P. FIGS. 11B and 11D illustrate a relation between a phase regulating boss 180*e* and the driving side development bearing 36. FIGS. 11C and 11D illustrate a state where the process cartridge P in which the development unit B1 and the photosensitive member unit C are coupled is not attached to the apparatus main body A2.

The coupling member 180 is capable of taking the following three attitudes. The first is a reference attitude D900 (drive-transmittable attitude). The reference attitude D900 refers to an attitude in which the rotational axis L2 of the coupling member 180 is coaxial with or in parallel to the rotational axis L3 of the driving force input gear 27. That is, the attitude indicates a state where the main body side driving member 100 of the image forming apparatus A1 is engaged with the coupling member 180 and the rotary force is transmitted as illustrated in FIG. 6A.

The second is a first inclination attitude D901 (at-spaced attitude). The first inclination attitude D901 indicates a state where the process cartridge P is positioned in the apparatus main body A2 of the image forming apparatus A1. The first inclination attitude D901 is an attitude in which, when the photosensitive drum 10 and the development roller 13 are spaced from each other at a retracted position (spacing position), the coupling member 180 is directed toward the main body side driving member 100 as a main body driving shaft (FIG. 18B).

A force applied to the coupling member 180 in such a state will be described. As illustrated in FIG. 11A, in the state of the first inclination attitude D901, the operation arm 185*c* of the coupling spring 185 contacts the guided portion 180*d* of the coupling member 180. Further, the operation arm 185*c* of the coupling spring 185 is configured to apply an urging force about a rotational axis X12 centered around the positioning portion 185*a* in a direction of an arrow 112. Thereby, the coupling member 180 receives an urging force F1*b* from the coupling spring 185. As a result, the coupling member 180 takes the first inclination attitude D901.

Figure 15:
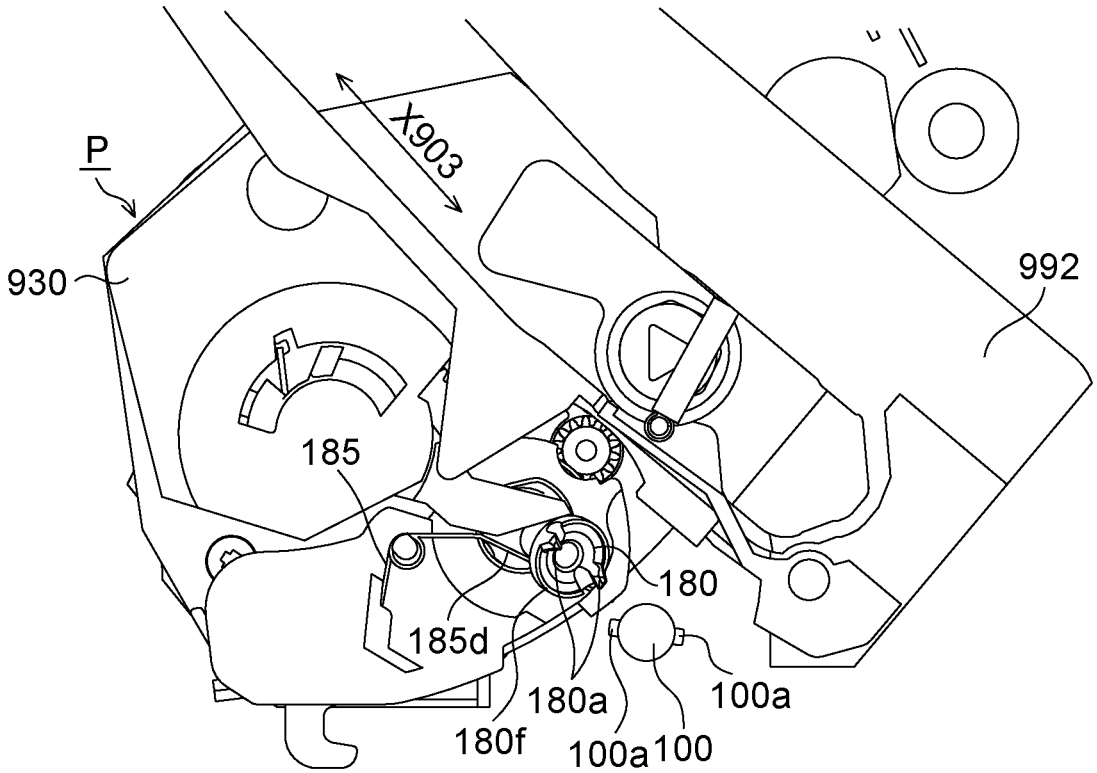
FIG. 15 illustrates a state where the process cartridge is being attached to the apparatus main body of the image forming apparatus.

The third is a second inclination attitude D902 (at-attaching attitude). The second inclination attitude D902 is an attitude in which, when the process cartridge P is attached to the apparatus main body A2 of the image forming apparatus A1, the rotary force receiving portion 180*a* and the supported portion 180*b* of the coupling member 180 are directed to a direction of the main body side driving member 100 of the apparatus main body A2 of the image forming apparatus A1 (FIG. 15).

Next, a force applied to the coupling member 180 in such a state will be described. As illustrated in FIG. 110, in the state of the second inclination attitude D901, the coupling member 180 receives an urging force F2 by the coupling lever spring 956 and the urging force F1*b* by the coupling spring 185. That is, a resultant force FL2 of the urging forces F2 and F1*b*, the coupling member 180 takes the second inclination attitude D902.

<Relation Between Coupling Member 180 and Driving Side Development Bearing 36>

Figure 12A:
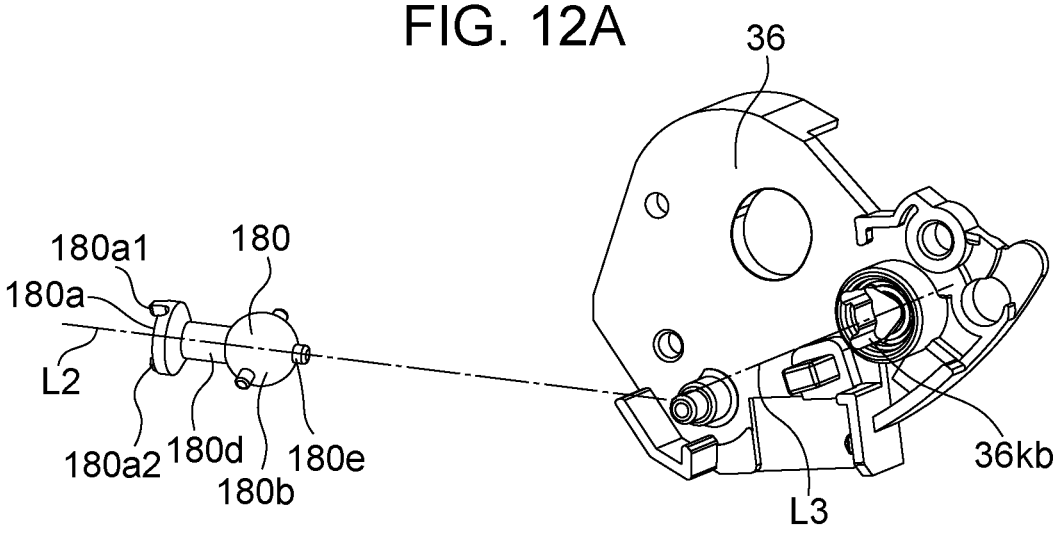
FIGS. 12A to 12D illustrate a relation between the driving side development bearing and a coupling member.
Figure 12B:
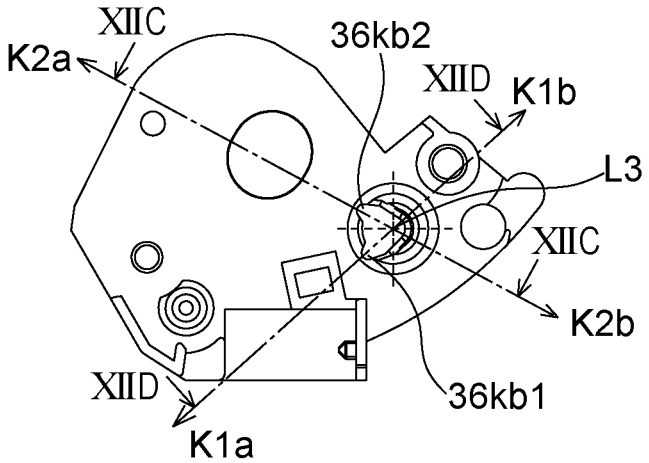
Figure 12C:
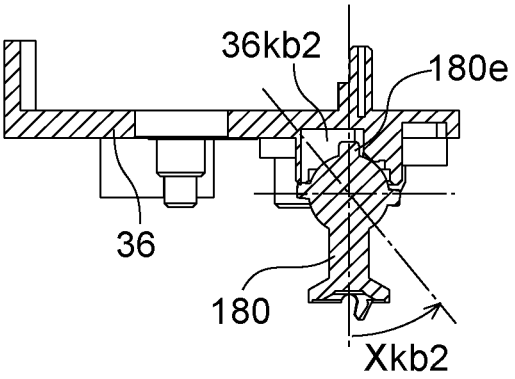
Figure 12D:
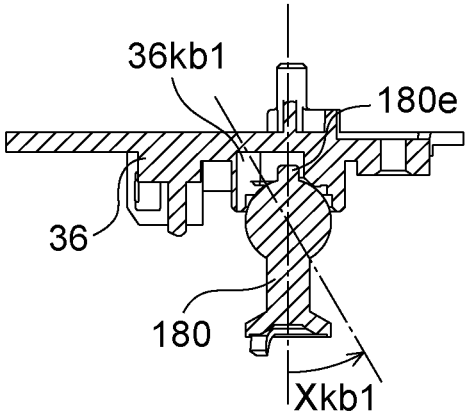

Then, an engagement relation between the coupling member 180 and the driving side development bearing 36 will be described. FIGS. 12A to 12D illustrate a relation between the driving side development bearing 36 and the coupling member 180. FIG. 12A is a perspective view illustrating positions of the driving side development bearing 36 and the coupling member 180. FIG. 12B is a view of the driving side development bearing 36 as seen from a front side on the driving side. FIG. 12C is a sectional view taken along a line XIIC-XIIC in FIG. 12B and FIG. 12D is a sectional view taken along a line XIID-XIID in FIG. 12B.

As illustrated in FIG. 12A, the coupling member 180 has the phase regulating boss 180*e* as a positioned portion (projection portion) coaxial with the rotational axis L2, at an end portion opposite from the free end portion 180*a*. On the other hand, the driving side development bearing 36 is provided with a phase regulating portion 36*kb* in a recess shape. In particular, the phase regulating portion 36*kb* is provided with a first inclination regulating portion 36*kb*1 and a second inclination regulating portion 36*kb*2 that are respectively recessed in a direction of an arrow K1*a* and a direction of an arrow K2*a* from the center of the rotational axis L3 of the driving force input gear 27. Here, the first inclination regulating portion 36*kb*1 functions as an at-spaced positioning portion for deciding a position of the coupling member 180 in the at-spaced attitude. The second inclination regulating portion 36*kb*2 functions as an at-attaching positioning portion for deciding the position of the coupling member 180 in the at-attaching attitude.

Here, the phase regulating boss 180*e* as the positioned portion of the coupling member 180 is arranged in the phase regulating portion 36*kb* of the driving side development bearing 36. That is, a position of the phase regulating boss 180*e* of the coupling member 180 is regulated by the phase regulating portion 36*kb* of the driving side development bearing 36. In other words, a configuration is such that the phase regulating boss 180*e* of the coupling member 180 is movable in the phase regulating portion 36*kb* of the driving side development bearing 36, and movable particularly to the first inclination regulating portion 36*kb*1 and the second inclination regulating portion 36*kb*2. Specifically, when the phase regulating boss 180*e* of the coupling member 180 moves to the first inclination regulating portion 36*kb*1 by the urging force F1*b*, the free end portion 180*a* (rotary force receiving portions 180*a*1 and 180*a*2) and the guided portion 180*d* of the coupling member 180 are inclined in a direction of an arrow K1*b*. The direction of the arrow K1*b* is opposed to the direction of the arrow K1*a*. That is, at this time, the coupling member 180 takes the first inclination attitude D901.

When the phase regulating boss 180*e* of the coupling member 180 moves to the second inclination regulating portion 36*kb*2 by the resultant force FL2 described above, the free end portion 180*a* and the guided portion 180*d* as a connecting portion are inclined in a direction of an arrow K2*b* that is opposed to the direction of the arrow K2*a*. That is, the coupling member 180 takes the second inclination attitude D902.

<Explanation of Operation of Regulating Member>

Figure 1A:
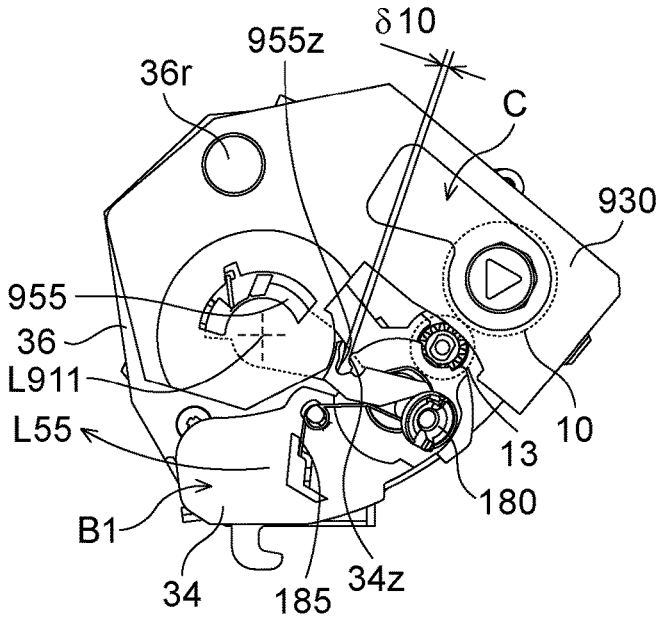
FIG. 1A is a side view of a process cartridge.
Figure 1C:
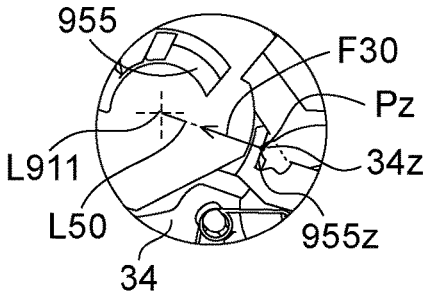
FIG. 1C is a partially enlarged view of a side view of the process cartridge.
Figure 1B:
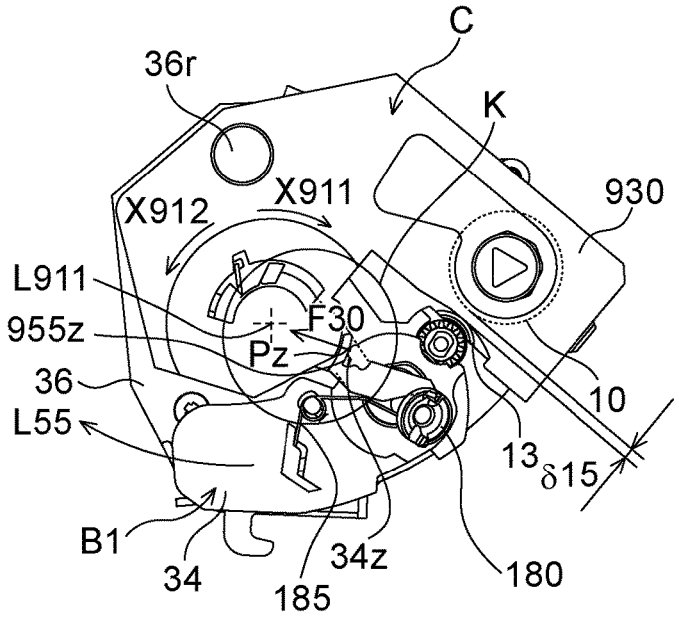
FIG. 1B is a side view of the process cartridge.

Next, an operation of the coupling lever 955 as the regulating member will be described with reference to FIGS. 1A and 1B. FIG. 1A is a side view of the process cartridge P while the photosensitive drum 10 contacts the development roller 13, as seen from a direction parallel to the rotational axis L1 of the photosensitive drum 10. FIG. 1B is a side view of the process cartridge P while the photosensitive drum 10 is spaced from the development roller 13, as seen from the direction parallel to the rotational axis L1 of the photosensitive drum 10. Both FIGS. 1A and 1B illustrate a spontaneous state in which the process cartridge P is detached from the apparatus main body A2, and a part of the coupling lever 955 is illustrated transparently by dotted lines in order to indicate a relation between the coupling lever 955 and the development side cover 34.

As described above, the development unit B1 is rotatable about the hang boss 36*r* of the driving side development bearing 36 in a direction (arrow L55) in which the development roller 13 and the photosensitive drum 10 are spaced from each other. Here, the coupling lever 955 is provided with the regulating portion 955*z*, which regulates movement of the development unit B1, between the rotational center (the rotational axis) L911 of the coupling lever 955 and the coupling member 180. The coupling lever 955 is urged in the direction X911 by the coupling lever spring 956 (refer to FIGS. 9A to 9D) and a guiding portion 955*e* contacts the guided portion 180*d* of the coupling member 180, so that the position of the coupling lever 955 is decided (refer to FIG. 11C).

The development side cover 34 includes a regulated portion 34*z*. As illustrated in FIG. 1A, when the photosensitive drum 10 contacts the development roller 13, the regulating portion 955*z* of the coupling lever 955 and the regulated portion 34*z* of the development side cover 34 are arranged so as to face each other, and a clearance 610 is provided.

Next, as illustrated in FIG. 1B, in a case where the development unit B1 moves in the direction of the arrow L55 so that the photosensitive drum 10 and the development roller 13 are spaced from each other by a certain distance 515, the regulating portion 955*z* of the coupling lever 955 contacts the regulated portion 34*z* of the development side cover 34. Thus, the development unit B1 is not able to move anymore in the direction of the arrow L55 (the movement is regulated). The position of the coupling lever 955 at this time is set as a regulating position at which movement of the development unit B1 in the direction of the arrow L55 is regulated. Here, a contact point between the regulating portion 955*z* and the regulated portion 34*z* is set as a point Pz. The regulating portion 955*z* is formed of a surface (arc surface that is centered around the rotational center L911) concentric with the rotational center L911 of the coupling lever 955. Thus, when movement of the development unit B1 in the direction of the arrow L55 is regulated, a force F30 is applied to the contact point Pz of the coupling lever 955. Further, the force F30 is applied in the direction of the rotational center L911 of the coupling lever 955. The coupling lever 955 is configured to be rotatable (in directions of the arrow X911 and an arrow X912) about the rotational center L911. Note that, the rotational axis of the coupling lever 955 is parallel to the rotational axis L1 of the photosensitive drum 10. On the other hand, the force F30 is applied in the direction of the rotational center L911 of the coupling lever 955 and a moment to make the coupling lever 955 rotate is not generated. Thus, the coupling lever 955 does not rotate even when the force F30 is applied thereto.

As described above, the regulated portion 34*z* of the development unit B1 contacts the regulating portion 955*z* of the coupling lever 955 and a moving amount in the direction of the arrow L55 is regulated to a predetermined amount (a moving amount by which the development roller 13 is spaced from the photosensitive drum 10 by the distance 615) or less. This prevents application of impact to the development unit B1 and the photosensitive member unit C, for example, when a user excessively moves the development unit B1 with respect to the photosensitive member unit C, for example, outside the apparatus main body A2 of the image forming apparatus A1. As a result, it is possible to prevent unnecessary breakage of the process cartridge P. Further, even when vibration or impact is applied while the process cartridge P that is produced is transported, the impact applied to the development unit 131 and the photosensitive member unit C is able to be suppressed because the movement of the development unit B1 is regulated to the minimum.

<Modification Example of Regulating Portion>

Figure 1D:
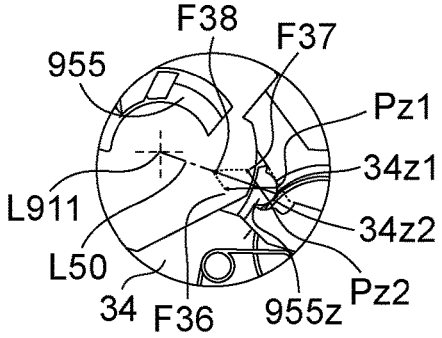
FIG. 1D is a partially enlarged view of a side view of the process cartridge.

Next, a modification of the regulating portion 955*z* will be described with reference to FIGS. 1C and 1D. FIGS. 1C and 1D are enlarged views of a vicinity part of the regulating portion 955*z* in a side view of the process cartridge P while the photosensitive drum 10 is spaced from the development roller 13, as seen from the direction parallel to the rotational axis L1 of the photosensitive drum 10.

A shape of the surface of the regulating portion 955*z* is not limited to the aforementioned shape and may be a plane substantially vertical to a straight line L50 that connects the rotational center L911 of the coupling lever 955 and the contact point Pz, as illustrated in FIG. 1C.

In addition, as illustrated in FIG. 1D, a configuration may be such that there are a plurality of contact points (a contact point of Pz1 and 34*z*1 and a contact point of Pz2 and 34*z*2) between the coupling lever 955 and the development unit B1 and a resultant force F38 of forces (F36 and F37) received from the points is directed toward the rotational center L911 of the coupling lever 955.

<Configuration for Attaching or Detaching Process Cartridge P to or from Apparatus Main Body A2 of Image Forming Apparatus A1>

Figure 13:
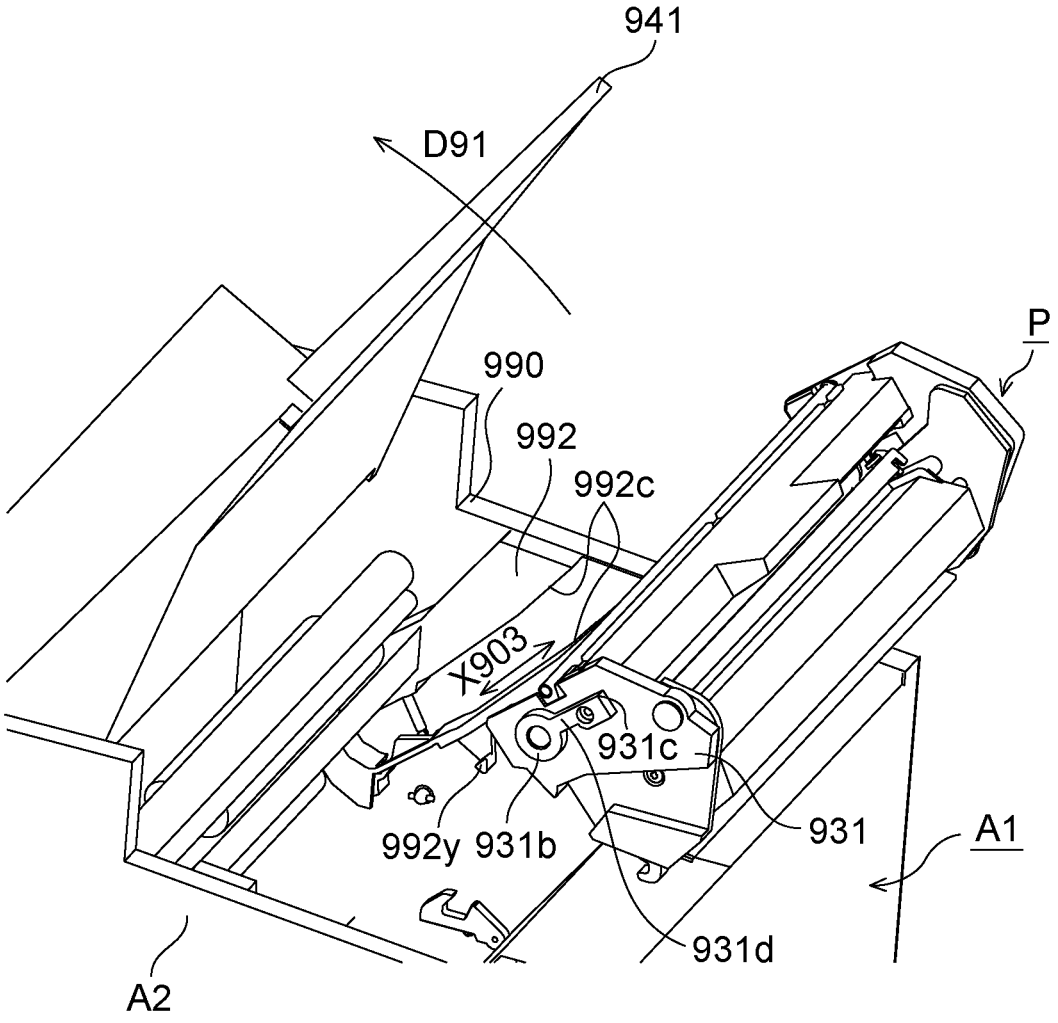
FIG. 13 is an explanatory perspective view of an apparatus main body of the image forming apparatus as seen from the non-driving side.
Figure 14:
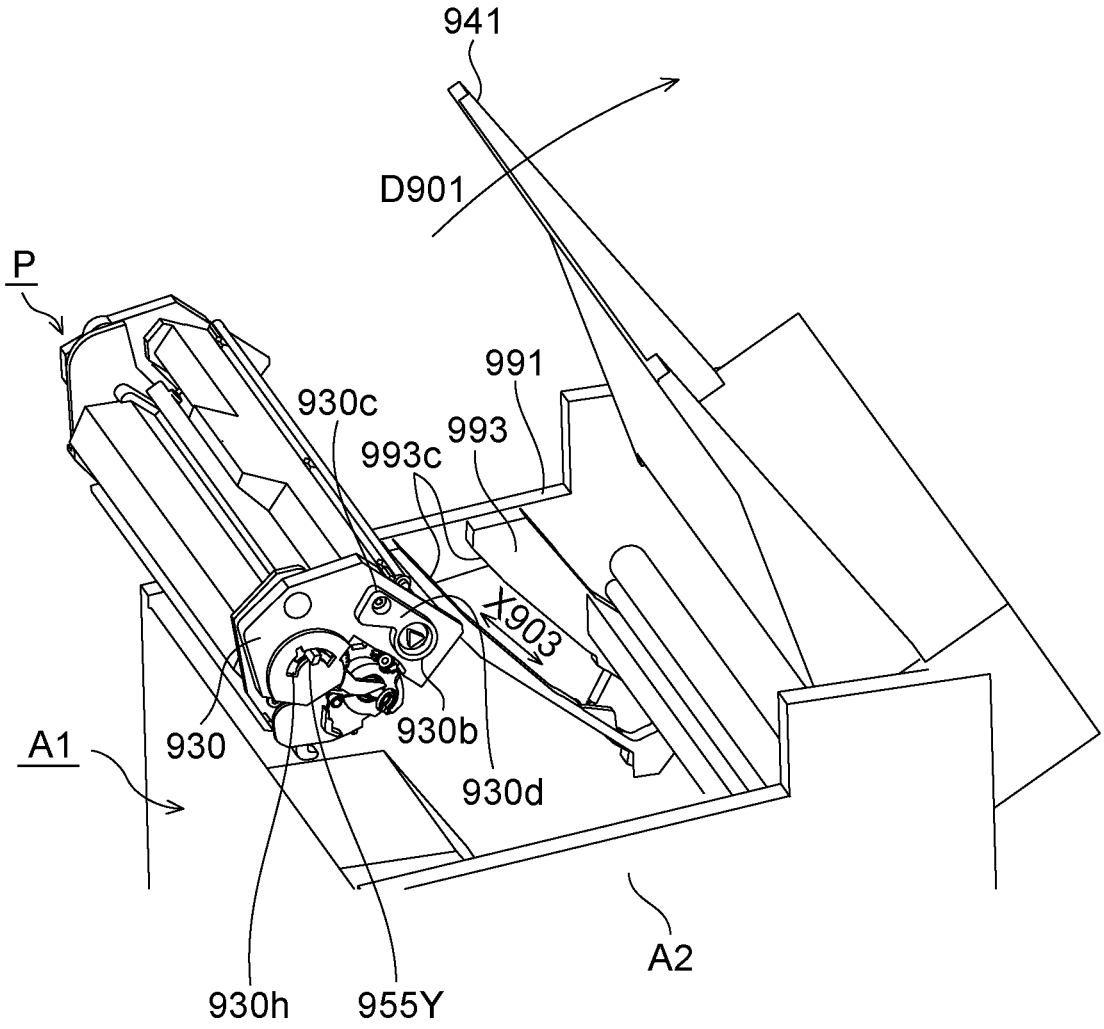
FIG. 14 is an explanatory perspective view of the apparatus main body of the image forming apparatus as seen from the driving side.
Figure 16:
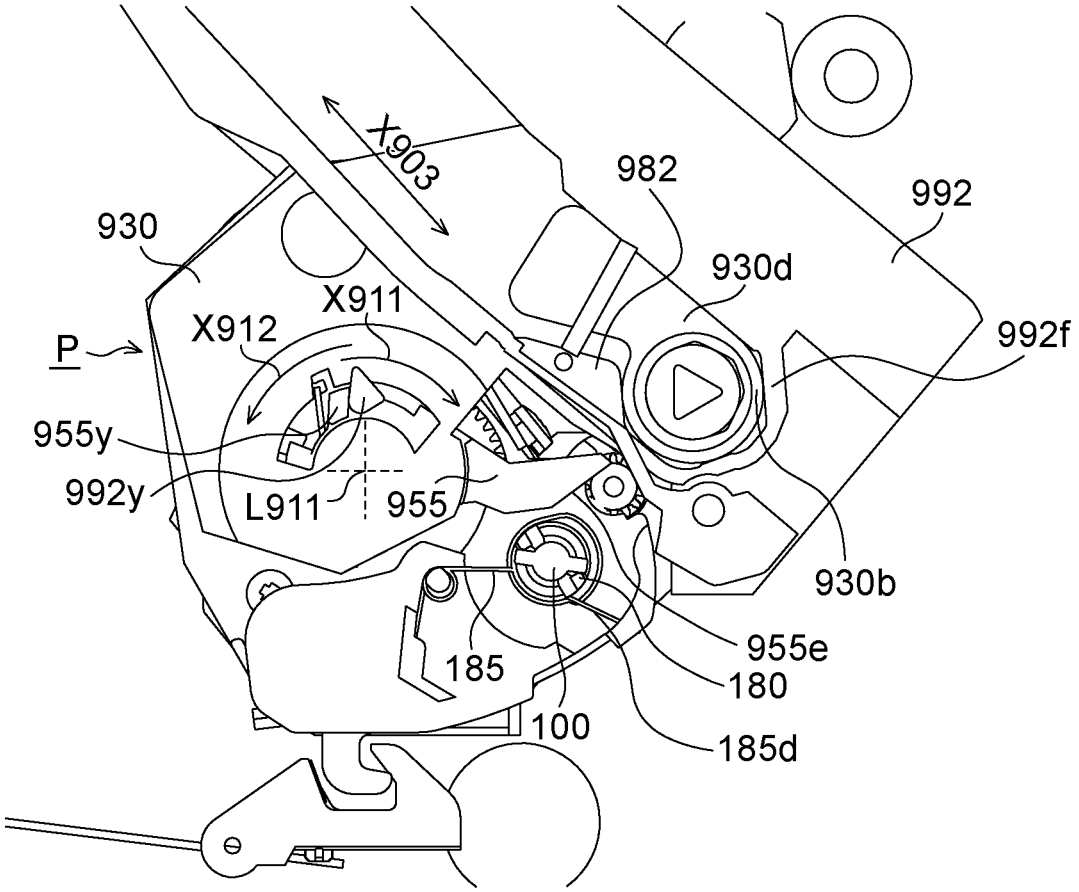
FIG. 16 illustrates a state where the attachment of the process cartridge to the apparatus main body of the image forming apparatus is completed.

Next, a method of attaching the process cartridge P to the apparatus main body A2 of the image forming apparatus A1 will be described with reference to FIGS. 13 to 16. FIG. 13 is an explanatory perspective view of the apparatus main body A2 of the image forming apparatus A1 as seen from the non-driving side and FIG. 14 is an explanatory perspective view of the apparatus main body A2 of the image forming apparatus A1 as seen from the driving side. FIG. 15 illustrates a state where the process cartridge P is being attached to the apparatus main body A2 of the image forming apparatus A1 and is a view seen from the direction of the rotational axis L1 of the photosensitive drum 10. FIG. 16 illustrates a state where the attachment of the process cartridge P to the apparatus main body A2 of the image forming apparatus A1 is completed and is a view seen from the direction of the rotational axis L1 of the photosensitive drum 10.

As illustrated in FIG. 13, the drum bearing member 931 is provided on the non-driving side of the process cartridge P and the drum bearing member 931 is provided with a guided portion 931*d*. The guided portion 931*d* has a positioning portion 931*b* and a rotation stop portion 931*c*.

As illustrated in FIG. 14, the drum bearing member 930 is provided on the driving side of the process cartridge P and the drum bearing member 930 is provided with a guided portion 930*d*. The guided portion 930*d* has a positioning portion 930*b* and a rotation stop portion 930*c*.

On the other hand, as illustrated in FIGS. 13 and 14, a driving-side side plate 990 that constitutes a housing of the apparatus main body A2 of the image forming apparatus A1 is provided on the driving side of the apparatus main body A2 of the image forming apparatus A1. The driving-side side plate 990 includes a driving side guide member 992. A non-driving-side side plate 991 is provided with a non-driving side guide member 993. The driving side guide member 992 includes a guiding portion 992*c* and the non-driving side guide member 993 includes a guiding portion 993*c*. A groove shape that extends along an attaching/detaching path X903 of the process cartridge P is formed in the guiding portion 992*c* of the driving side guide member 992 and the guiding portion 993*c* of the non-driving side guide member 993. The driving side guide member 992 also includes an abutting portion 992*y* that contacts and presses the rotation regulating portion (pressed portion) 955*y* of the coupling lever 955 in a process where the process cartridge P is attached.

<Attachment of Process Cartridge P to Apparatus Main Body A2>

A method of attaching the process cartridge P to the apparatus main body A2 will be described. As illustrated in FIGS. 13 and 14, a main body cover 941 that is arranged at a top part of the apparatus main body A2 of the image forming apparatus A1 and is openable/closable is rotated in an opening direction D91. Thereby, the inside of the apparatus main body A2 of the image forming apparatus 1 is exposed.

The photosensitive member unit C of the process cartridge P is provided with the drum bearing member 931 on the non-driving side and the drum bearing member 930 on the driving side. The guided portion 931*d* (FIG. 13) of the drum bearing member 931 is engaged with the guiding portion 993*c* (FIG. 14) of the non-driving side guide member 993 of the apparatus main body A2 of the image forming apparatus A1, and the guided portion 930*d* (FIG. 14) of the drum bearing member 930 of the process cartridge P is engaged with the guiding portion 992*c* (FIG. 13) of the driving side guide member 992 of the apparatus main body A2 of the image forming apparatus A1. Thereby, the process cartridge P has the photosensitive member unit C guided by the guiding portion 992*c* and the guiding portion 993*c* and is inserted into the apparatus main body A2 of the image forming apparatus A1 along the attaching/detaching path X903 formed by the guiding portion 992*c* and the guiding portion 993*c*. Note that, a direction in which the process cartridge P moves along the attaching/detaching path X903 is a direction intersecting (orthogonal to) the rotational axis L1 of the photosensitive drum 10.

When the process cartridge P is attached to the apparatus main body A2 of the image forming apparatus A1, the coupling member 180 in the state of the second inclination attitude D902 described above is inserted into the apparatus main body A2 of the image forming apparatus A1. The positioning portion 930*b* of the drum bearing member 930 receives an urging force from a driving side pressing member 982. Thereby, the positioning portion 930*b* contacts a positioning portion 992*f* provided in the driving side guide member 992 (refer to FIG. 16).

On the non-driving side as well, the non-driving side of the process cartridge P is positioned and fixed to the non-driving side guide member 993, with a similar configuration to that of the driving side.

As a result, the drum bearing member 930 of the process cartridge P is positioned and fixed to the driving side guide member 992 and the drum bearing member 931 thereof is positioned and fixed to the non-driving side guide member 993 (refer to FIG. 16).

<Operation of Coupling Member 180 in Attaching Process of Process Cartridge P>

Next, an operation of the coupling member 180 in an attaching process of the process cartridge P will be described with reference to FIGS. 15 and 16. FIG. 15 illustrates a state where the process cartridge P is on the attaching/detaching path X903 in the attaching process of the process cartridge P. FIG. 16 illustrates a state where the attachment of the process cartridge P is completed.

A configuration is such that, when the process cartridge P is on the attaching/detaching path X903, the rotary force receiving portions 180*a*1 and 180*a*2 of the coupling member 180 are directed toward a direction (attaching direction) of the main body side driving member 100 of the apparatus main body A2 of the image forming apparatus A1.

In the attaching process of the process cartridge P, the coupling member 180 keeps the second inclination attitude D902 by the urging forces applied from the coupling lever 955 and the coupling lever spring 956. After an annular portion 180*f* of the coupling member 180 contacts the main body side driving member 100, the process cartridge P is further inserted in the attaching direction (a lower rig direction of the arrow X903). Then, as illustrated in FIG. 16, the rotation regulating portion 955*y* of the coupling lever 955 contacts the abutting portion 992*y* of the driving side guide member 992. This is because the rotation regulating portion 955*y* is provided in a part of the coupling lever 955, which protrudes from a surface of the drum bearing member 930, in a direction that is orthogonal to the attaching direction and parallel to the rotational axis L1 of the photosensitive drum 10.

When the process cartridge P is further inserted in the attaching direction, the coupling lever 955 is pressed by the abutting portion 992*y* and rotates in the direction of the arrow X912 about the rotational axis L911. Thereby, the guiding portion 955*e* is spaced from the guided portion 180*d* of the coupling member 180. The position of the coupling lever 955 that is decided by the rotation regulating portion 955*y* contacting the abutting portion 992*y* when the attachment of the process cartridge P is completed is set as a nonregulating position. When the coupling lever 955 is at the nonregulating position, a surface 955*w* is not allowed to contact the regulated portion 34*z* and the position of the development side cover 34 is not regulated.

Then, the coupling member 180 is engaged with the main body side driving member 100 and becomes coaxial with a rotational axis of the driving force input gear 27. In other words, the rotary force receiving portions 180*a*1 and 180*a*2 of the coupling member 180 and the rotary force applying portions 100*a* (100*a*1 and 100*a*2) of the main body side driving member 100 are positioned so as to be engaueable with each other (FIG. 6B). The attitude of the coupling member 180 at this time is the reference attitude D900. At this time, the phase regulating boss 180*e* of the coupling member 180 is disengaged from the second inclination regulating portion 36*kb*2 of the driving side development bearing 36, and does not contact any part of the phase regulating portion 36*kb* of the driving side development bearing 36 (FIG. 12C).

Figure 17A:
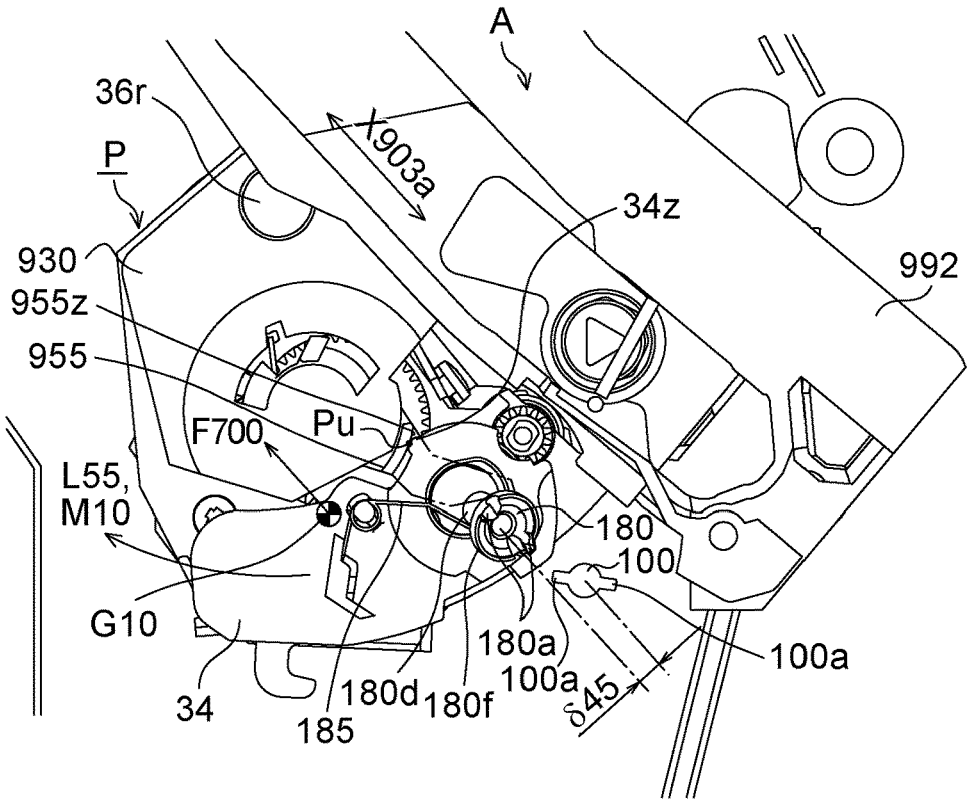
FIGS. 17A and 17B illustrate the process cartridge and a driving side guide member.
Figure 17B:
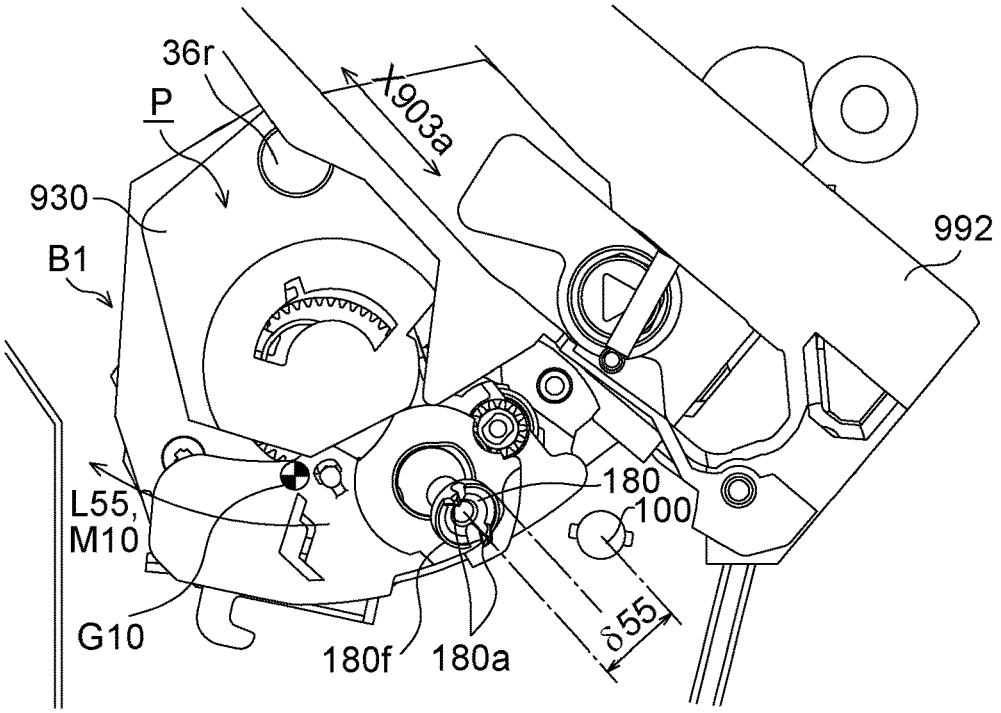

Here, an operation of the coupling lever 955 as the regulating member when the process cartridge P is attached to the apparatus main body A2 of the image forming apparatus A1 will be described with reference to FIGS. 17A and 17B. FIGS. 17A and 17B illustrate the process cartridge P and the driving side guide member 992 as seen from the direction parallel to the rotational axis L1 of the photosensitive drum 10.

As illustrated in FIG. 17A, when the process cartridge P is attached to the apparatus main body A2 of the image forming apparatus A1, the process cartridge P may move with an acceleration in a direction of an arrow X903*a*. In such a case, an inertial force F700 is applied to a point at the center-of-gravity G10 of the development unit B1 in a direction parallel to the arrow X903*a*. Here, the development unit B1 is rotatable about the hang boss 36*r* with respect to the photosensitive member unit C as described above. Thus, a moment M10 in a clockwise direction about the hang boss 36*r* acts on the development unit B1 by the inertial force F700. As a result, the development unit B1 moves in the direction of the arrow L55 with respect to the photosensitive member unit C.

However, since the regulating portion 955*z* of the coupling lever 955 contacts the regulated portion 34*z* of the development side cover 34 at a point Pu as described above, movement of the development unit B1 is regulated when the development unit B1 has moved in the direction of the arrow L55 by a certain amount. As a result, it is possible to reduce a misalignment 545 between the coupling member 180 of the process cartridge P and the main body side driving member 100 of the apparatus main body A2 of the image forming apparatus A1 that are engaged in the attaching process of the process cartridge P. At this time, the misalignment is an amount of deviation between the center of the coupling member 180 and the center of the main body side driving member 100 in a direction vertical to the lower right direction X903*a* in which the process cartridge P is attached to the apparatus main body A2 of the image forming apparatus A1. As a result, the process cartridge P is able to be attached to the apparatus main body A2 in a state where the coupling member 180 is appropriately engaged with the main body side driving member 100. In other words, the process cartridge P is able to be attached to the apparatus main body A2 with the photosensitive member unit C and the development unit B1 in an appropriate state.

Here, the misalignment 645 between the coupling member 180 and the main body side driving member 100 is able to be controlled by a size of the clearance 610 between the regulating portion 955*z* of the coupling lever 955 and the regulated portion 34*z* of the development side cover 34, which is illustrated in FIG. 1A. Thus, the clearance 610 between the regulating portion 955*z* of the coupling lever 955 and the regulated portion 34*z* of the development side cover 34 may be set as appropriate on the basis of the misalignment 645 that allows engagement of the coupling member 180 and the main body side driving member 100.

Then, a case where the coupling lever 955 as the regulating member is not provided will be described with reference to FIG. 17B. In a case where the process cartridge P is moved with an acceleration in the lower right direction of the arrow X903*a* with respect to the apparatus main body A2 of the image forming apparatus A1 in the configuration in which the coupling lever 955 is not provided, the moment M10 in the clockwise direction acts on the development unit B1 as described above. As a result, the development unit B1 moves in the direction of the arrow L55 with respect to the photosensitive member unit C.

In this case, when the coupling lever 955 is not provided, the development unit B1 moves greatly in the direction of the arrow L55 compared to the aforementioned configuration in which the coupling lever 955 is provided. Therefore, a misalignment 555 between the coupling member 180 of the process cartridge P and the main body side driving member 100 of the apparatus main body A2 of the image forming apparatus A1 that need to be engaged in the attaching process of the process cartridge P is greater than that of the configuration in which the coupling lever 955 is provided. As a result, in the attaching process of the process cartridge P, the coupling member 180 of the process cartridge P and the main body side driving member 100 of the apparatus main body A2 of the image forming apparatus A1 are not able to contact or not able to be engaged with each other. That is, the process cartridge P is not able to receive driving from the apparatus main body A2 of the image forming apparatus A1. Such a state can be said as a state where the process cartridge P is attached to the apparatus main body A2 with the photosensitive member unit C and the development unit B1 in an inappropriate state.

Accordingly, by regulating relative movement of the development unit B1 with respect to the photosensitive member unit C by the regulating portion 955*z* of the coupling lever 955 as described above, the coupling member 180 is able to be stably engaged with the main body side driving member 100 of the apparatus main body A2 of the image forming apparatus A1.

<Development Contacting and Spacing>

In the present embodiment, a so-called contact developing method is used in which the development roller 13 bearing the toner t2 on the surface thereof directly contacts the photosensitive drum 10 to develop an electrostatic latent image on the photosensitive drum 10. The development roller 13 is constituted by the axis portion 13*e* and the rubber portion 13*d*. The axis portion 13*e* is a slender electroconductive cylinder of aluminum or the like, and a middle part thereof in the longitudinal direction covered with the rubber portion 13*d* (refer to FIG. 3). Here, the rubber portion 13*d* covers the axis portion 13*e* so that an outer shape thereof is coaxial with the axis portion 13*e*. The magnet roller 12 is built in the cylinder of the axis portion 13*e*. The rubber portion 13*d* bears the toner t2 at a peripheral surface thereof, and the axis portion 13*e* is supplied with bias. By making the rubber portion 13*d* bearing the toner t2 contact the surface of the photosensitive drum 10, the electrostatic latent image on the photosensitive drum 10 is developed.

In the present embodiment, as described above, the development unit B1 is always urged toward the photosensitive member unit C by the development urging member (not illustrated) in the direction in which the development roller 13 contacts the photosensitive drum 10.

Here, in the state where the development roller 13 contacts the photosensitive drum 10, the toner t2 born on the development roller 13 is able to be supplied and bonded to the photosensitive drum 10, and a position of the development unit B1 with respect to the photosensitive drum 10 at this time is set as a first position.

Figure 18A:
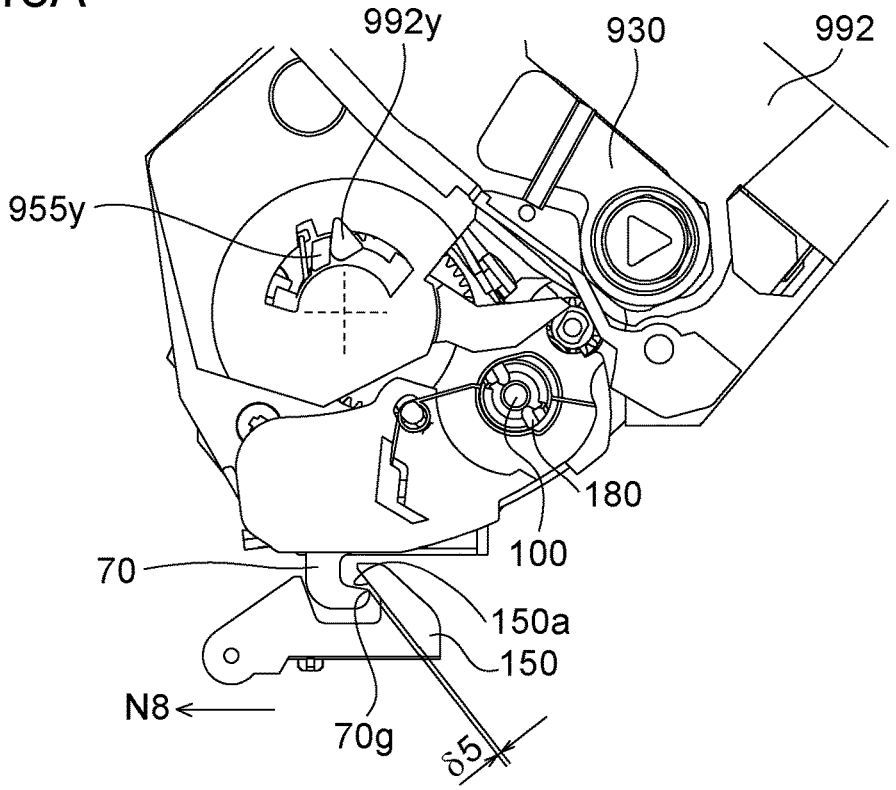
FIGS. 18A and 18B illustrate the process cartridge and the driving side guide member.
Figure 18B:
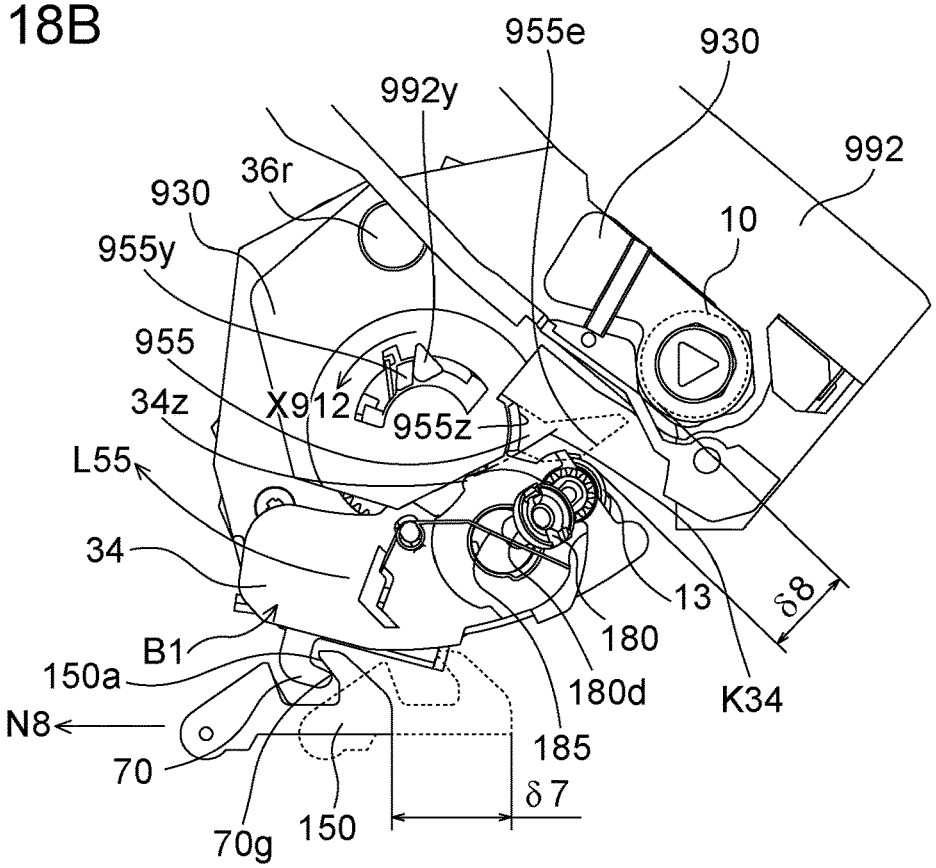

FIG. 18A is a view in which the process cartridge P, which is in a contact state where the development roller 13 contacts the photosensitive drum 10, and the driving side guide member 992 are seen from an axial direction of the photosensitive drum 10, and in which the development unit B1 is at the first position with respect to the photosensitive drum 10. FIG. 18B is a view in which the process cartridge P, in which the development unit B1 is in a spaced state where the development roller 13 is spaced from the photosensitive drum 10, and the driving side guide member 992 are seen from the axial direction of the photosensitive drum 10. In the case of the contact developing method as in the present embodiment, when a state where the development roller 13 always contacts the photosensitive drum 10 is kept, there is possibility that the rubber portion 13*d* of the development roller 13 deforms. For this reason, it is desirable that the development roller 13 is kept spaced from the photosensitive drum 10 in a non-development period. That is, it is desirable that the state where the development roller 13 contacts the photosensitive drum 10 and the state where the development roller 13 is spaced from the photosensitive drum 10 are taken.

As illustrated in FIG. 18A, the driving side contacting/spacing lever 70 includes a spaced surface 70*g* projecting toward the direction of the development roller 13. The spaced surface 70*g* is configured to be engageable with a first contacting surface 150*a* of a pressing member 150 provided in the apparatus main body A2 of the image forming apparatus A1. The pressing member 150 is configured to receive a driving force from a motor (not illustrated) and is movable in a direction of an arrow N8. Note that, since the abutting portion 992*y* contacts the rotation regulating portion 955*y* in the contact state, the coupling lever 955 is at the nonregulating position.

Next, an operation of shifting to the state where the development roller 13 is spaced from the photosensitive drum 10 will be described. In the contact state between the development roller 13 and the photosensitive drum 10 as illustrated in FIG. 18A, the first contacting surface 150*a* and the spaced surface 70*g* are spaced from each other with a gap of a distance 65.

FIG. 18B illustrates a state where the pressing member 150 moves in the direction of the arrow N8 by a distance 67. When the pressing member 150 moves in the direction of the arrow N8, the spaced surface 70*g* of the driving side contacting/spacing lever 70 contacts the first contacting surface 150*a* of the pressing member 150. At this time, the development unit B1 is supported so as to be swingable in the direction of the arrow L55. Thus, when the pressing member 150 moves in the direction of the arrow N8, the development unit B1 moves in the direction of the arrow L55. At this time, the development roller 13 and the photosensitive drum 10 are brought into a state of being spaced form each other with a gap of a distance 68. Here, a position of the development unit B1 with respect to the photosensitive drum 10 in the state where the photosensitive drum 10 and the development roller 13 are spaced from each other by 68 is set as a second position. That is, the development roller 13 is farther from the photosensitive drum 10 when the development unit B1 is at the second position, compared to a case where the development unit B1 is at the first position. In other words, a distance between rotational centers of the development roller 13 and the photosensitive drum 10 is longer when the development unit B1 is at the second position, compared to the case where the development unit B1 is at the first position.

The non-driving side also has a configuration similar to that of the driving side, and the non-driving side contacting/spacing lever 72 is pressed by a pressing member 150 different from the pressing member 150 that presses the driving side contacting/spacing lever 70. Thereby, the development unit B1 rotates in the direction of the arrow L55 about the hang boss 36*r* (FIG. 18B) provided in the driving side development bearing 36. As a result, the development roller 13 and the photosensitive drum 10 are spaced from each other by the distance 68.

In this manner, depending on the position of the pressing member 150 provided in the apparatus main body A2 of the image forming apparatus A1, the contact state or the spacing state between the photosensitive drum 10 and the development roller 13, that is, a developing position (first position) or a retracting position (second position) of the development unit B1 is selected as necessary.

When the state where the development roller 13 contacts the photosensitive drum 10 as illustrated in FIG. 18A is shifted to the state where the development roller 13 is spaced from the photosensitive drum 10 as illustrated in FIG. 18B, the drum bearing member 930 is in a state of being positioned and fixed to the driving side guide member 992. That is, the abutting portion 922*y* contacts the rotation regulating portion 955*y* of the coupling lever 955 and the coupling lever 955 is kept at the nonregulating position, and the guiding portion 955*e* is retracted from the guided portion 180*d* of the coupling member 180. At this time, the regulating portion 955*z* of the coupling lever 955 is retracted from a track K34 of the regulated portion 34*z* of the development side cover 34 when the development unit B1 rotates in the direction of the arrow L55. Thus, the spacing operation of the development unit B1 in the direction of the arrow L55 is not regulated.

<Detachment of Process Cartridge P from Apparatus Main Body A2>

Next, detachment of the process cartridge P from the apparatus main body A2 will be described. The process cartridge P is detached from the apparatus main body A2 not only to replace the process cartridge P with a new one, but also to perform maintenance of the process cartridge P or the image forming apparatus A1 as described below.

For example, when replenishing the toner t2 to the process cartridge P, the user detaches the process cartridge P from the apparatus main body A2 and then detaches the toner bottle T from the development unit B1, and attaches a new toner bottle T to the development unit B1. After that, the user attaches the process cartridge P to the apparatus main body A2. In a case of cleaning the photosensitive drum 10 or the charging roller 11, when the recording medium 2 enters into the process cartridge P, the user detaches the process cartridge P from the apparatus main body A2. Then, after performing the cleaning and removing the recording medium 2, the user attaches the process cartridge P to the apparatus main body A2. In a case where the recording medium 2 is jammed in a conveyance path of the recording medium 2, which is formed by the conveyance guides 3*d* and 3*f* and the like, the user detaches the process cartridge P from the apparatus main body A2. After removing the recording medium 2 from the apparatus main body A2, the user performs the cleaning and removes the recording medium 2 and then attaches the process cartridge P to the apparatus main body A2.

In the process of detaching the process cartridge P from the apparatus main body A2, an operation opposite to the attaching operation of the process cartridge P to the apparatus main body A2 as described with reference to FIGS. 15 and 16 is generated. When the process cartridge P is moved in a direction opposite to the attaching direction X903 from the state illustrated in FIG. 16 in which the coupling lever 955 is at the nonregulating position, the abutting portion 992*y* moves relatively with respect to the coupling lever 955. Since the coupling lever 955 is urged in the direction of the arrow X911 by the coupling lever spring 956, rotation in the direction of the arrow X911 is performed while contact with the rotation regulating portion 955*y* and the abutting portion 992*y* is kept. Further, when the process cartridge P is moved in the direction opposite to the attaching direction X903, the guiding portion 955*e* contacts the guided portion 180*d* of the coupling member 180 by the urging force of the coupling lever spring 956 as illustrated in FIGS. 15 and 11C. Thereby, the position of the coupling lever 955 is decided at the regulating position. At almost the same timing, the abutting portion 992*y* is spaced from the rotation regulating portion 955*y* and pressing of the abutting portion 992*y* against the rotation regulating portion 955*v* is released. Also in the state where the process cartridge P is detached from the apparatus main body A2, the coupling lever 955 is kept at the regulating position by the urging force of the coupling lever spring 956. In this manner, in the process where the process cartridge P is detached from the apparatus main body A2, the coupling lever 955 automatically moves from the nonregulating position to the regulating position by the urging force of the coupling lever spring 956. Thus, the user does not need to move the coupling lever 955 from the nonregulating position to the regulating position by himself/herself and lowering of usability is suppressed accordingly.

As a result, for example, even when the development unit B1 is moved vigorously with respect to the photosensitive member unit C after the process cartridge P attached to the apparatus main body A2 once is detached from the apparatus main body A2, breakage of the development unit B1 and the photosensitive member unit C is suppressed. Moreover, when the process cartridge P attached to the apparatus main body A2 once is detached from the apparatus main body A2 and then attached to the apparatus main body A2 again, the coupling member 180 is engaged with the main body side driving member 100 and the process cartridge P is able to be attached in an appropriate state.

Figure 19A:
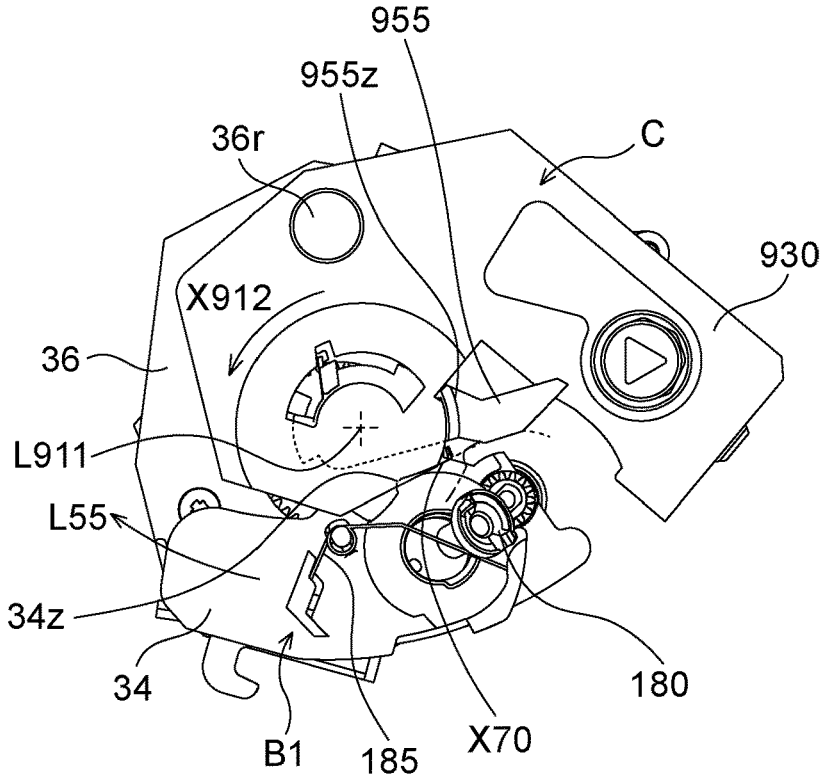
FIGS. 19A and 19B are side views of the process cartridge.
Figure 19B:
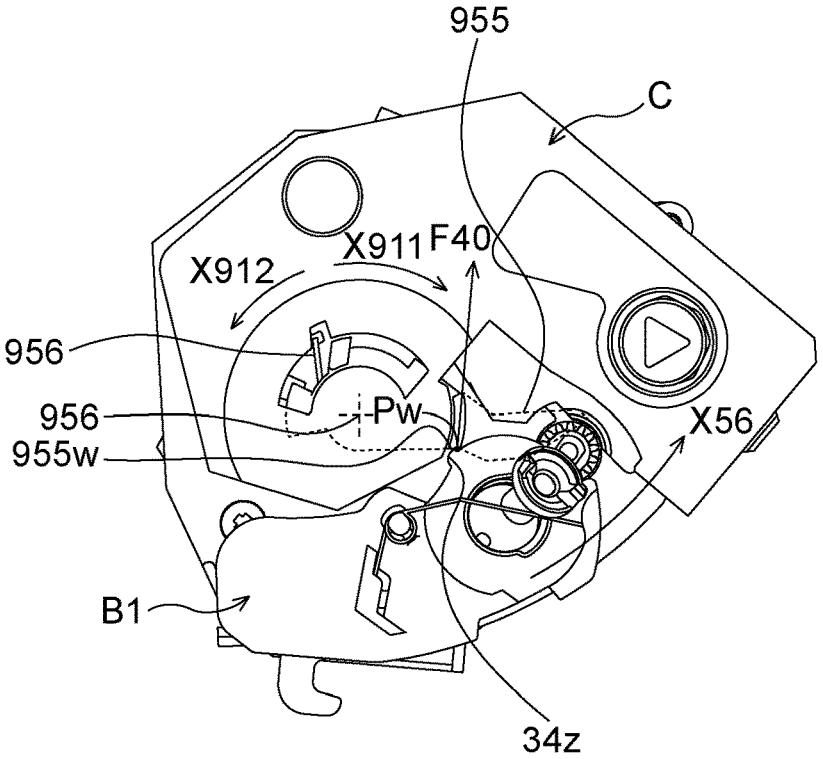

FIGS. 19A and 19B illustrate the process cartridge P as seen from the direction parallel to the rotational axis L1 of the photosensitive drum 10. As illustrated in FIG. 19A, in a case where the user erroneously rotates the coupling lever 955 in the direction of the arrow X912, the regulating portion 955*z* of the coupling lever 955 moves with the rotation of the coupling lever 955 in the direction of the arrow X912. In such a state, the regulating portion 955*z* of the coupling lever 955 is at the nonregulating position retracted from a trace X70 of the development side cover 34 when the development unit B1 rotates in the direction of the arrow L55. Thus, the spacing operation of the development unit B1 in the direction of the arrow L55 is not regulated and the development unit B1 is allowed to be greatly spaced from the photosensitive member unit C.

However, when the user stops the operation of rotating the coupling lever 955 in the direction of the arrow X912 in such a state, the coupling lever 955 rotates in the direction of the arrow X911 by the urging force of the coupling lever spring 956 as illustrated in FIG. 19B. Then, the surface 955*w* of the coupling lever 955 is brought into a state of contacting the regulated portion 34*z* of the development side cover 34. Here, a contact point between the surface 955*w* of the coupling lever 955 and the regulated portion 34*z* of the development side cover 34 is set as a point Pw. Further, as described above, since the development unit B1 is always urged by an urging member (not illustrated) in the direction in which the photosensitive drum 10 contacts the development roller 13, the development unit F1 moves to rotate in a direction of an arrow X56. Thus, the coupling lever 955 receives a force F40 at the contact point Pw. Thereby, the coupling lever 955 rotates in the direction of the arrow X912 and the development unit B1 moves to rotate in the direction of the arrow X56. As a result, the coupling lever 955 is able to be returned to the regulating position illustrated in FIG. 1A automatically.

The urging force of the coupling lever spring 956 and the urging force of the urging member (not illustrated) that urges the development unit B1 toward the first position are set so that the coupling lever 955 rotates in the direction of the arrow X912 by a force Pw at the contact point Pw. Thereby, the coupling lever 955 is able to be returned to the regulating position automatically without performing a returning operation by the user.

Second Embodiment

Figure 20:
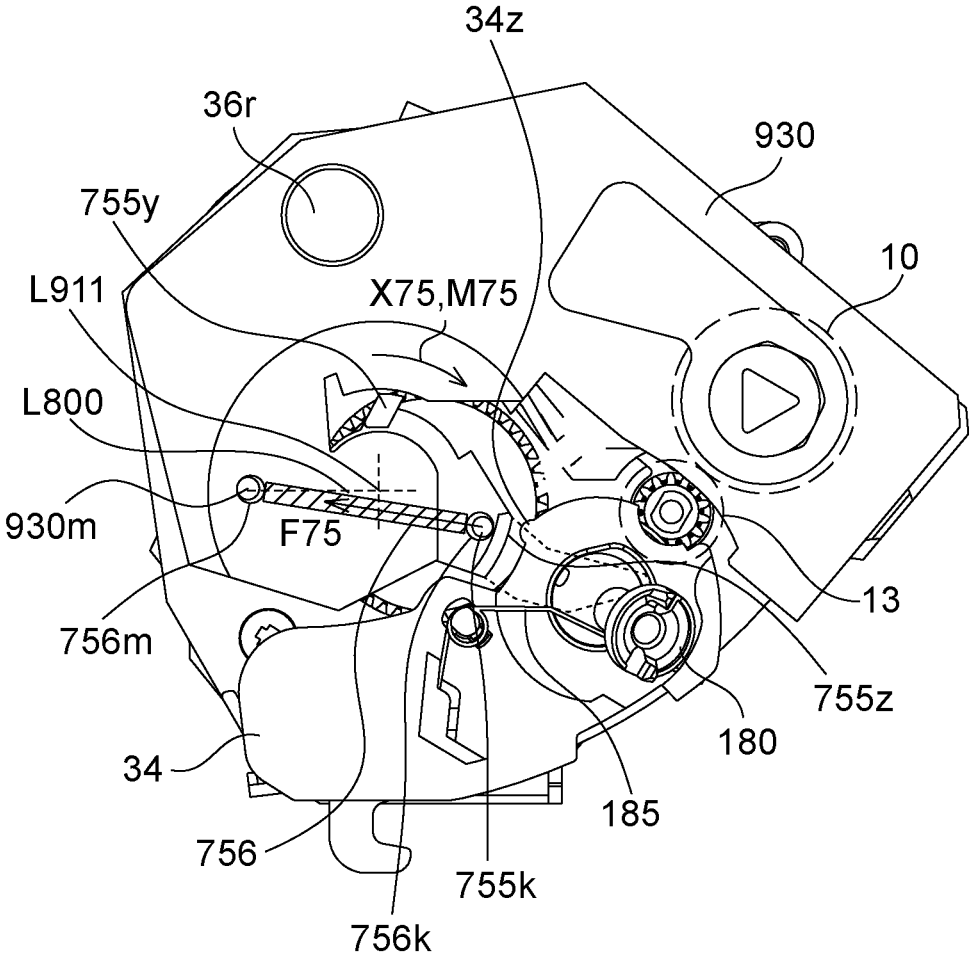
FIG. 20 is a side view of the process cartridge.

Next, a second embodiment will be described with reference to FIGS. 20 and 21. Note that, since a basic apparatus configuration of the present embodiment is the same as that of the first embodiment described above, redundant parts will be omitted. Members having the same functions as those of the first embodiment described above will be given the same reference signs.

The first embodiment has the configuration in which the twisted coil spring that is the coupling lever spring 956 always urges the coupling lever 955 toward the regulating position. On the other hand, in the present embodiment, a configuration in which a direction in which a coupling lever is urged by a spring varies depending on a position of the coupling lever will be described. FIG. 20 illustrates the process cartridge P that is not attached to the apparatus main body A2 of the image forming apparatus A1, as seen from the axial direction of the photosensitive drum 10. A projection 755*k* of a coupling lever 755 is engaged with one end 756*k* of a coupling lever spring 756. Further, attachment is performed in a state where a protection 930*m* of the drum bearing member 930 is engaged with the other end 756*m* of the coupling lever spring 756. At this time, an urging force F75 is applied to the projection 755*k* of the coupling lever 755 through the coupling lever spring 756. Here, a straight line connecting the center of the projection 930*m* of the drum bearing member 930 and the rotational center L911 of the coupling lever 755 is set as a straight line L800. At this time, the projection 755*k* of the coupling lever 755 is closer to a regulating position of the coupling lever 755 than the straight line L800. As a result, a moment M75 in a direction of an arrow X75 acts on the coupling lever 755. That is, the coupling lever 755 is held at the regulating position. When the coupling lever 755 is at the regulating position, the regulated portion 34*z* is contactable with the regulating portion 755*z* and a movement of the developing unit B1 with respect to the photosensitive member unit C is regulated.

Figure 21:
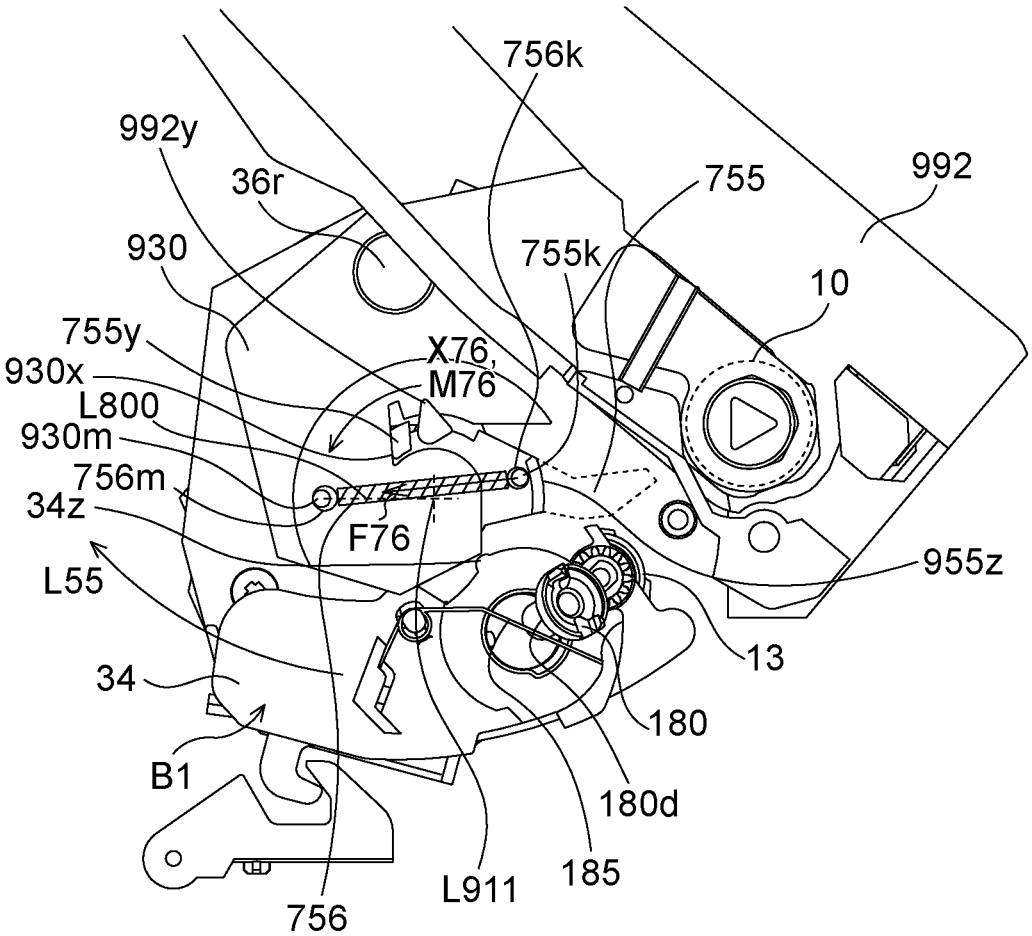
FIG. 21 is a side view of the process cartridge.

Next, FIG. 21 illustrates the process cartridge P in a state of being attached to the apparatus main body A2 of the image forming apparatus A1, as seen from the axial direction of the photosensitive drum 10. As described above, the driving side guide member 992 is provided with the abutting portion 992*y* that contacts a rotation regulating portion 755*y* of the coupling lever 755 in the attaching process of the process cartridge P. Thus, in the process where the process cartridge P is attached to the apparatus main body A2 of the image forming apparatus A1, the coupling lever 755 rotates to the nonregulating position. At this time, the projection 755*k* of the coupling lever 755 is closer to the nonregulating position of the coupling lever 755 than the straight line L800 described above. As a result, a moment M76 that acts on the coupling lever 755 by an urging force F76 of the coupling lever spring 756 is a direction of an arrow X76 (a direction in which the coupling lever 755 is directed to the nonregulating position). By the moment P176, the coupling lever 755 rotates in the direction of the arrow X76 and the rotation regulating portion 755*y* contacts a contacting portion 930*x* of the drum bearing member 930, so that an attitude of the coupling lever 755 is uniquely decided. That is, the coupling lever 755 is held at the nonregulating position.

At this time, the rotation regulating portion 755*y* of the coupling lever 755 does not contact the abutting portion 992*y* of the driving side guide member 992. In this manner, in the present embodiment, the direction in which the coupling lever spring 756 urges the coupling lever 755 varies depending on the position of the coupling lever 755, so that the coupling lever 755 is able to be urged so as to be directed to the nonregulating position and held at the nonregulating position.

As a result, the coupling lever 755 is able to be held at the nonregulating position without applying a load to the apparatus main body A2 of the image forming apparatus A1, so that stiffness does not need to be increased to prevent deformation of the apparatus main body A2 side of the image forming apparatus A1. As a result, it is possible to reduce a size of the abutting portion 992*y* and achieve reduction in a size of the apparatus main body A2 of the image forming apparatus A1.

The image forming apparatus A1 further includes a contacting portion (not illustrated) that returns the coupling lever 755 to the regulating position in the process where the process cartridge P is detached from the image forming apparatus A1. Thereby, when the process cartridge P is outside the apparatus main body A2 of the image forming apparatus A1, the coupling lever 755 is held at the regulating position, similarly to the first embodiment. According to the present embodiment, an effect similar to that of the first embodiment is able to be obtained.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-104162 filed May 26, 2017, which is hereby incorporated by reference herein in its entirety.

What is claimed is:

1. A cartridge comprising:

a first frame;

a photosensitive member rotatably supported by the first frame;

a second frame movable with respect to the first frame between a first position and a second position;

a developer bearing member rotatably supported by the second frame, wherein the developer bearing member is capable of supplying the developer to the photosensitive member when the second frame is in the first position and the developer bearing member is farther from the photosensitive member than the first position when the second frame is in the second position;

a regulating member that is movable between a regulating position at which the regulating member contacts the first frame and the second frame to regulate movement of the second frame from the first position to the second position and a non-regulating position at which movement of the second frame is not regulated; and an urging member that urges the regulating member to move the regulating member from the non-regulating position to the regulating position.

2. The cartridge according to claim 1, further comprising:

a rotary force receiving member that rotates by receiving a rotary force, wherein the regulating member at the regulating position contacts the rotary force receiving member.

3. The cartridge according to claim 2, wherein the rotary force received by the rotary force receiving member is transmitted to the developer bearing member.

4. The cartridge according to claim 1, wherein the regulating member rotates around a rotational axis parallel to a rotational axis of the photosensitive member and thereby moves between the regulating position and the non-regulating position.

5. The cartridge according to claim 4, wherein a direction in which the regulating member receives a force from the second frame when the second frame contacts the regulating member is a direction in which the regulating member is pressed against the rotational axis.

6. The cartridge according to claim 4, wherein a surface of the regulating member that the second frame contacts is an arc surface that is centered around the rotational axis.

7. The cartridge according to claim 1 further comprising:

a second frame urging member that urges the second frame to be directed from the second position to the first position.

8. The cartridge according to claim 1, wherein the first frame is provided with a support member that rotatably supports the second frame, and the regulating member is supported by the support member so as to be movable between the regulating position and the non-regulating position.

9. The cartridge according to claim 8, wherein the regulating member is provided with a pressed portion that receives a force by which the regulating member is moved from the regulating position to the non-regulating position, and the pressed portion is provided in a projection portion that projects toward a direction of a rotational axis of the developer bearing member from the support member.

10. The cartridge according to claim 1, wherein the cartridge according to claim 1 is a cartridge attached to an electrophotographic image forming apparatus, the regulating member is provided with a pressed portion that receives a force, and when the pressed portion is pressed by a pressing portion of the electrophotographic image forming apparatus in a process where the cartridge is attached to the electrophotographic image forming apparatus, the regulating member moves from the regulating position to the non-regulating position.

11. The cartridge according to claim 10, wherein when pressing of the pressing portion against the pressed portion is released, the regulating member moves from the non-regulating position to the regulating position by urging of the urging member.

12. The cartridge according to claim 1, further comprising:

a guided portion that is guided by an electrophotographic image forming apparatus to move in a direction intersecting a direction of a rotational axis of the photosensitive member of the first frame in a process where the cartridge is attached to the electrophotographic image forming apparatus.

13. The cartridge according to claim 1, wherein a direction in which the urging member urges the regulating member varies depending on a position of the regulating member, and the urging member is able to urge the regulating member to be directed from the regulating position to the non-regulating position.

14. The cartridge according to claim 1, wherein the second frame is provided with a developer unit attaching portion to which a developer unit containing the developer is detachably attachable.

15. A cartridge comprising:

a first frame;

a photosensitive member rotatably supported by the first frame;

a second frame movable with respect to the first frame between a first position and a second position;

a developer bearing member rotatably supported by the second frame, wherein the developer bearing member is capable of supplying the developer to the photosensitive member when the second frame is in the first position and the developer bearing member is farther from the photosensitive member than the first position when the second frame is in the second position;

a regulating member that is movable between a regulating position at which the regulating member contacts the first frame and the second frame to regulate movement of the second frame from the first position to the second position and a non-regulating position at which movement of the second frame is not regulated; and a rotary force receiving member that rotates by receiving a rotary force, wherein the regulating member at the regulating position contacts the rotary force receiving member.

16. The cartridge according to claim 15, wherein the rotary force received by the rotary force receiving member is transmitted to the developer bearing member.

17. The cartridge according to claim 15, wherein the regulating member rotates around a rotational axis parallel to a rotational axis of the photosensitive member and thereby moves between the regulating position and the non-regulating position.

18. The cartridge according to claim 17, wherein a direction in which the regulating member receives a force from the second frame when the second frame contacts the regulating member is a direction in which the regulating member is pressed against the rotational axis.

19. The cartridge according to claim 17, wherein a surface of the regulating member that the second frame contacts is an arc surface that is centered around the rotational axis.

20. The cartridge according to claim 15 further comprising:

a second frame urging member that urges the second frame to be directed from the second position to the first position.

21. The cartridge according to claim 15, wherein the first frame is provided with a support member that rotatably supports the second frame, and the regulating member is supported by the support member so as to be movable between the regulating position and the non-regulating position.

22. The cartridge according to claim 21, wherein the regulating member is provided with a pressed portion that receives a force by which the regulating member is moved from the regulating position to the non-regulating position, and the pressed portion is provided in a projection portion that projects toward a direction of a rotational axis of the developer bearing member from the support member.

23. The cartridge according to claim 15, wherein the regulating member is provided with a pressed portion that receives a force, and when the pressed portion is pressed by a pressing portion of an electrophotographic image forming apparatus in a process where the cartridge is attached to the electrophotographic image forming apparatus, the regulating member moves from the regulating position to the non-regulating position.

24. The cartridge according to claim 15, further comprising:

a guided portion that is guided by an electrophotographic image forming apparatus to move in a direction intersecting a direction of a rotational axis of the photosensitive member of the first frame in a process where the cartridge is attached to the electrophotographic image forming apparatus.

25. The cartridge according to claim 15, wherein the second frame is provided with a developer unit attaching portion to which a developer unit containing the developer is detachably attachable.

26. A cartridge comprising:

a first frame;

a photosensitive member rotatably supported by the first frame;

a second frame movable with respect to the first frame between a first position and a second position;

a developer bearing member rotatably supported by the second frame, wherein the developer bearing member is capable of supplying the developer to the photosensitive member when the second frame is in the first position and the developer bearing member is farther from the photosensitive member than the first position when the second frame is in the second position; and a regulating member that is movable between a regulating position at which the regulating member contacts the first frame and the second frame to regulate movement of the second frame from the first position to the second position and a non-regulating position at which movement of the second frame is not regulated, wherein the regulating member rotates around a rotational axis parallel to a rotational axis of the photosensitive member and thereby moves between the regulating position and the non-regulating position, and a surface of the regulating member that the second frame contacts is an arc surface that is centered around the rotational axis.

27. The cartridge according to claim 26 further comprising:

a second frame urging member that urges the second frame to be directed from the second position to the first position.

28. The cartridge according to claim 26, wherein the first frame is provided with a support member that rotatably supports the second frame, and the regulating member is supported by the support member so as to be movable between the regulating position and the non-regulating position.

29. The cartridge according to claim 28, wherein the regulating member is provided with a pressed portion that receives a force by which the regulating member is moved from the regulating position to the non-regulating position, and the pressed portion is provided in a projection portion that projects toward a direction of a rotational axis of the developer bearing member from the support member.

30. The cartridge according to claim 26, wherein the regulating member is provided with a pressed portion that receives a force, and when the pressed portion is pressed by a pressing portion of an electrophotographic image forming apparatus in a process where the cartridge is attached to the electrophotographic image forming apparatus, the regulating member moves from the regulating position to the non-regulating position.

31. The cartridge according to claim 26, further comprising:

a guided portion that is guided by an electrophotographic image forming apparatus to move in a direction intersecting a direction of a rotational axis of the photosensitive member of the first frame in a process where the cartridge is attached to the electrophotographic image forming apparatus.

32. The cartridge according to claim 26, wherein the second frame is provided with a developer unit attaching portion to which a developer unit containing the developer is detachably attachable.

* * * * *